US009908014B1

(12) United States Patent
Wester et al.

(10) Patent No.: US 9,908,014 B1
(45) Date of Patent: Mar. 6, 2018

(54) GOLF CLUB

(71) Applicant: Taylor Made Golf Company, Inc., Carlsbad, CA (US)

(72) Inventors: Christian Reber Wester, San Diego, CA (US); Nathan T. Sargent, Oceanside, CA (US); Joseph Reeve Nielson, Vista, CA (US); Christopher John Harbert, Carlsbad, CA (US); Hong G. Jeon, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 15/247,716

(22) Filed: Aug. 25, 2016

Related U.S. Application Data

(63) Continuation of application No. 14/717,864, filed on May 20, 2015.

(60) Provisional application No. 62/001,602, filed on May 21, 2014, provisional application No. 62/028,573, filed on Jul. 24, 2014.

(51) Int. Cl.
*A63B 53/04* (2015.01)

(52) U.S. Cl.
CPC .... *A63B 53/0466* (2013.01); *A63B 2053/042* (2013.01); *A63B 2053/0408* (2013.01); *A63B 2053/0416* (2013.01); *A63B 2053/0433* (2013.01)

(58) Field of Classification Search
CPC ..... A63B 53/0466
See application file for complete search history.

(56) References Cited

U.S. PATENT DOCUMENTS

| | | | |
|---|---|---|---|
| 3,897,066 | A | 7/1975 | Belmont |
| 5,447,309 | A | 9/1995 | Vincent |
| 6,146,571 | A | 11/2000 | Vincent et al. |
| 6,254,494 | B1 | 7/2001 | Hasebe |
| 6,872,152 | B2 | 3/2005 | Beach et al. |
| 6,939,247 | B1 | 9/2005 | Schweigert et al. |
| 7,198,575 | B2 | 4/2007 | Beach et al. |
| 7,611,424 | B2 | 11/2009 | Nagai et al. |
| 7,824,280 | B2 | 11/2010 | Yokota |
| 8,430,763 | B2 | 4/2013 | Beach et al. |

(Continued)

OTHER PUBLICATIONS

Bond Laminates, "Advanced thermoplastic composites—Tepex", pp. 1-7 (2013).*

*Primary Examiner* — Michael Dennis
(74) *Attorney, Agent, or Firm* — Klarquist Sparkman LLP

(57) ABSTRACT

In one embodiment the golf club head includes three main components, a frame component, a rear cap component, and a striking plate.

In another embodiment the club head may also comprise a front component, which is manufactured as a single unitary piece, and a rear cap component. The front component may also be overmolded by a thermoplastic polymeric outer portion which may or may not cover the striking face and which provides additional reinforcement at the load bearing sections of the club head and allows a more facile connection to the rear cap component.

In another embodiment, a club head having a main body, crown insert, sole insert and metal face plate frame is formed by forming the sole insert and crown insert from a polymeric material using a thermoforming or thermosetting process and then injection molding the main body over the sole insert, crown insert and metal face plate frame.

4 Claims, 38 Drawing Sheets

(56) References Cited

U.S. PATENT DOCUMENTS

| | | | | |
|---|---|---|---|---|
| 8,550,934 | B2 * | 10/2013 | Evans | A63B 53/0466 473/324 |
| 2004/0116207 | A1 | 6/2004 | DeShiell et al. | |
| 2004/0121185 | A1 | 6/2004 | Caldwell et al. | |
| 2005/0159243 | A1 * | 7/2005 | Chuang | A63B 53/0466 473/345 |
| 2006/0122004 | A1 | 6/2006 | Chen et al. | |
| 2006/0135281 | A1 * | 6/2006 | Palumbo | A01K 87/00 473/316 |
| 2006/0229141 | A1 * | 10/2006 | Galloway | A63B 53/0466 473/345 |
| 2008/0113827 | A1 | 5/2008 | Werner et al. | |
| 2008/0139339 | A1 | 6/2008 | Cheng | |
| 2008/0261715 | A1 | 10/2008 | Carter | |
| 2010/0137074 | A1 | 6/2010 | Gilbert et al. | |
| 2011/0159986 | A1 | 6/2011 | Chao et al. | |
| 2013/0178306 | A1 | 7/2013 | Beno et al. | |
| 2014/0080628 | A1 | 3/2014 | Sargent et al. | |
| 2014/0162809 | A1 * | 6/2014 | Soracco | A63B 60/54 473/332 |
| 2015/0038259 | A1 * | 2/2015 | Sander | A63B 53/0466 473/342 |
| 2015/0057101 | A1 | 2/2015 | Sander | |

* cited by examiner

GOLF CLUB

CROSS REFERENCE TO RELATED APPLICATIONS

This application is a continuation of U.S. patent application Ser. No. 14/717,864, which was filed on May 20, 2015, which claims the benefit of U.S. Provisional Application No. 62/001,602, which was filed on May 21, 2014, and U.S. Provisional Application No. 62/028,573, which was filed on Jul. 24, 2014, all of which are incorporated herein by reference in their entirety.

BACKGROUND

With the ever-increasing popularity and competitiveness of golf, substantial effort and resources are currently being expended to improve golf clubs. Much of the recent improvement activity has involved the combination of the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods."

The current ability to fashion metalwood club-heads of strong, light-weight metals and other materials has allowed the club-heads to be made hollow. Use of materials of high strength and high fracture toughness has also allowed club-head walls to be made thinner, which has allowed increases in club-head size, compared to earlier club-heads. Larger club-heads tend to have a larger striking face area and can also be made with high club-head inertia, thereby making the club-heads more "forgiving" than smaller club-heads. Characteristics such as size of the sweet spot are determined by many variables including the shape profile, size, and thickness of the strike plate as well as the location of the center of gravity (CG) of the club-head.

An exemplary metalwood golf club such as a driver or fairway wood typically includes a hollow shaft having a lower end to which the club-head is attached. Most modern versions of these club-heads are made, at least in part, of a light-weight but strong metal such as titanium alloy. In most cases, the club-head comprises a body to which a face plate (used interchangeably herein with the terms "face" or "face insert" or "striking plate" or "strike plate") is attached or integrally formed. The strike plate defines a front surface or strike face that actually contacts the golf ball.

Regarding the total mass of the metalwood club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the metalwood club-head to address performance issues, for example. Thus the ability to reduce the structural mass of the metalwood club-head without compromising strength and structural support provides the potential for increasing discretionary mass and hence improved club performance.

Some current approaches to reducing structural mass of a metalwood club-head are directed to making at least a portion of the club-head of an alternative material. Whereas the bodies and face plates of most current metalwoods are made of titanium alloy, several club-heads are available that are made, at least in part, of components formed from either graphite/epoxy-composite (or other suitable composite material) and a metal alloy. Graphite composites have a density of approximately 1.5 g/cm$^3$, compared to titanium alloy which has a density of 4.5 g/cm$^3$, which offers tantalizing prospects for providing more discretionary mass in the club-head. Composite materials that are useful for making metalwood club-head components often include a fiber portion and a resin portion. In general, the resin portion serves as a "matrix" in which the fibers are embedded in a defined manner. In a composite for club-heads, the fiber portion may be configured as multiple fibrous layers or plies that are impregnated with the resin component.

For example, in one group of such club-heads a portion of the body is made of carbon-fiber (graphite)/epoxy composite and a titanium alloy is used as the primary face-plate material. Other club-heads are made entirely of one or more composite materials. The ability to utilize lighter composite materials in the construction of the face plate can also provide some significant weight and other performance advantages To date there have been relatively few golf club head constructions involving a polymeric material as an integral component of the design. Although such materials possess the requisite light weight to provide for significant weight savings, it is often difficult to utilize these materials in areas of the club head subject to the stresses resulting from the high speed impact of the golf ball. The golf club constructions of the present disclosure provide for a golf club which utilizes a lightweight polymeric material in the golf club head allowing for the freeing up of more discretionary weight and further promote performance and adjustability in the resulting golf club head.

SUMMARY

In one embodiment the golf club head includes three main components, a frame component, a rear cap component, and a striking plate.

In another embodiment the club head may also comprise a front component, which is manufactured as a single unitary piece, and a rear cap component. The front component may also be overmolded by a thermoplastic polymeric outer portion which may or may not cover the striking face and which provides additional reinforcement at the load bearing sections of the club head and allows a more facile connection to the rear cap component.

In another embodiment, the club head may also comprise a unitary body having a shell which may also be formed with a hosel and a front opening and a strike plate which is fitted to front opening of the frame portion. The shell can be selectively strengthened by overmolding it over one or more upper or crown reinforcing inserts and one or more sole or skirt reinforcing inserts.

In an especially preferred embodiment, the rear shell has a gap or discontinuity in the shell where it has been overmolded over one or more upper or crown reinforcing inserts to form a crown channel and/or a gap or discontinuity in the shell where it has been overmolded over one or more lower or sole or skirt reinforcing inserts to form a sole or skirt channel.

In another especially preferred embodiment, the rear shell is formed as a two layered structure comprising an injection molded inner layer and an outer layer comprising a thermoplastic composite laminate. In an especially preferred method of preparation a so called hybrid molding process may be used in which the composite laminate outer layer is insert molded to the injection molded inner layer to provide additional strength.

In order to i) selectively strengthen the club head at the load bearing portions where higher strength is required and ii) also provide a bonding surface for the subsequently attached striking face insert and iii) facilitate the ease of production of the final club head, the shell can be overmolded over a one piece frame insert.

In yet another embodiment, the club head may be manufactured by separately forming a crown insert and sole insert from a polymeric material, such as a carbon composite material, using a thermoforming or thermosetting process. Thereafter, the sole insert and crown insert may be coated with a heat activated adhesive, and then placed in a mold with a face plate frame preferably made of metal, such as titanium or titanium alloy. The main body is overmolded (or injection molded) over the crown insert, sole insert and face plate frame using a thermoplastic composite material, such as a carbon composite having short fibers conducive to injection molding.

The resulting golf club head has a main body made of a thermoplastic composite material to which the crown insert and sole insert are bonded and by which the face plate frame is mechanically captured. A face plate may be mechanically fastened, adhered or otherwise secured to the face plate frame.

The foregoing will become more apparent from the following figures and detailed description.

DETAILED DESCRIPTION

Figure 1A:
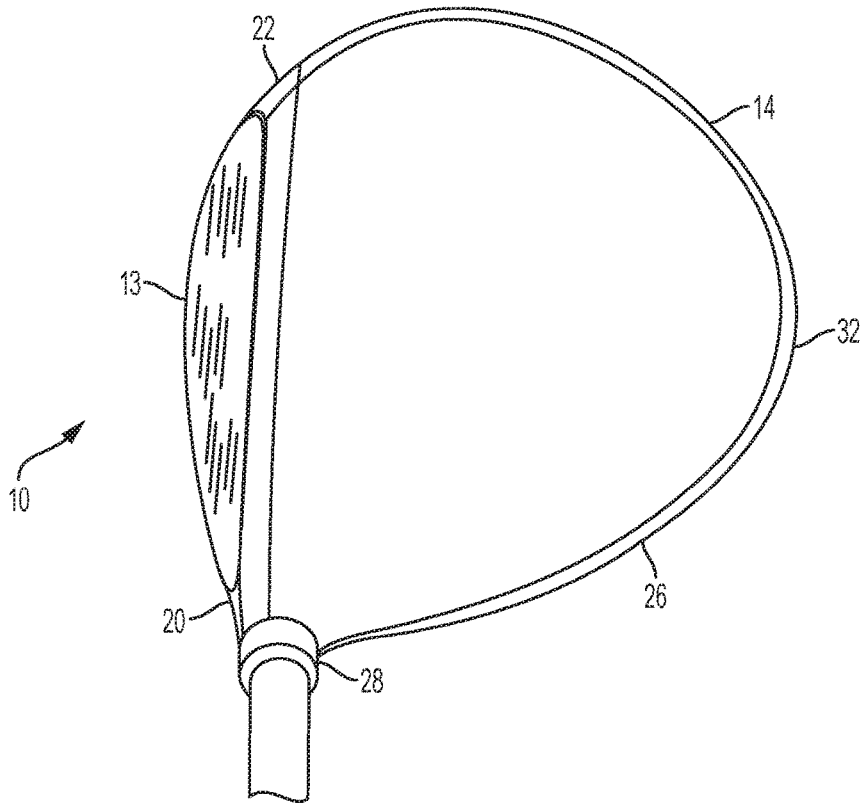
FIG. 1A is a top view depiction of a "metalwood" club-head.

The following describes embodiments of golf club heads for metalwood type golf clubs, including drivers, fairway woods, utility clubs (also known as hybrid clubs) and the like.

The following inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises."

The following also makes reference to the accompanying drawings which form a part hereof. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

For reference, within this disclosure, reference to a "driver type golf club head" means any wood type golf club head intended to be used primarily with a tee. In general, driver type golf club heads have lofts of 14 degrees or less, and, more usually, of 12 degrees or less. Reference to a "fairway wood type golf club head" means any wood type golf club head intended to be used with or without a tee. In general, fairway wood type golf club heads have lofts of 15 degrees or greater, and, more usually, 16 degrees or greater. In general, fairway wood type golf club heads have a length from leading edge to trailing edge of 73-97 mm. Various definitions distinguish a fairway wood type golf club head from a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Driver type golf club heads of the current disclosure may be 15 degrees or less in various embodiments or 10.5 degrees or less in various embodiments. In various embodiments, fairway wood type golf club heads of the current disclosure may be from 13-26 degrees.

Figure 1B:
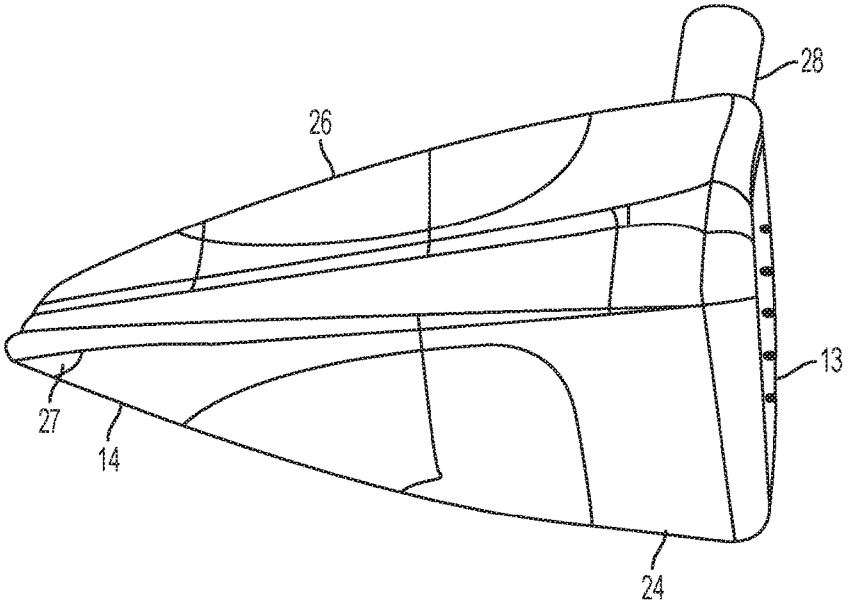
FIG. 1B is a side view depiction of a "metalwood" club-head.

The main features of an exemplary "metalwood" clubhead 10 are depicted in FIGS. 1A and 1B. The metal wood club head 10 has a volume, typically measured in cubic-centimeters ($cm^3$), equal to the volumetric displacement of the club head 10, assuming any apertures are sealed by a substantially planar surface. (See United States Golf Association "Procedure for Measuring the Club Head Size of Wood Clubs," Revision 1.0, Nov. 21, 2003). In the case of a driver, the golf club head has a volume greater than about 350 $cm^3$, and a total mass between approximately 145 g and approximately 245 g. In the case of a fairway wood, the golf club head 10 has a volume less than or equal to about 350 $cm^3$ and greater than about 150 $cm^3$, and a total mass between approximately 145 g and approximately 260 g. In the case of a utility or hybrid club the golf club head 10 has a volume less than or equal to about 150 $cm^3$, and a total mass between approximately 145 g and approximately 280 g.

Further with reference to FIGS. 1A and 1B, the club-head 10 comprises a body 14. The body 14 has a heel 20, a toe 22, a rear portion 32, a sole 24, a top or crown 26, and a hosel 28. The strike plate 13 is attached to the body 14 and defines a front surface or strike face that actually contacts the golf ball. As used herein, the skirt 27 is the side portion of the club-head 10 between the crown 26 and the sole 24 that extends across a periphery of the club head, excluding the striking surface 13, from the toe portion 22, around the rear portion 32, to the heel portion 20.

Figure 2:
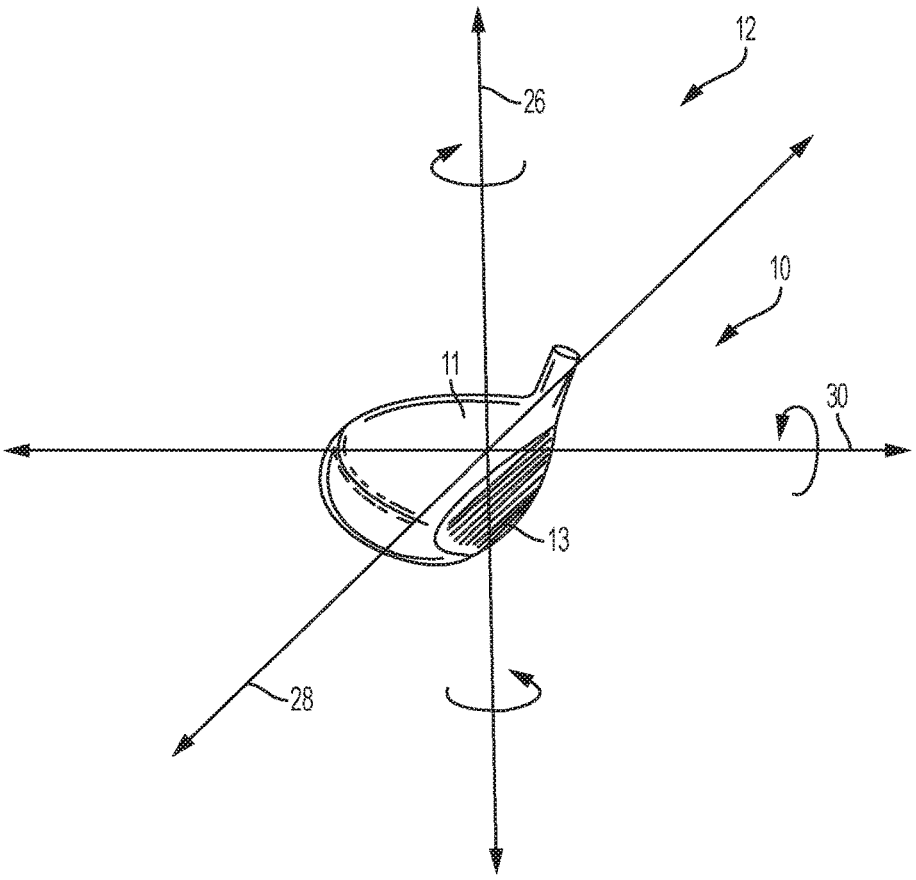
FIG. 2 is a front view of a golf club head centered about a coordinate system.

In order to define further features which may be included on the golf club heads it is informative to first of all define a coordinate system to provide a reference to the placement of these additional features. This coordinate system as shown in FIG. 2 is hereby defined with respect to a generic golf club head but applies equally to the golf club heads of the present disclosure in their assembled form. FIG. 2 is a perspective view of a club head 10 located about a coordinate system 12. The coordinate system 12 is centered about the center of gravity 11 of the club head.

The coordinate system comprises three axes: (i) a vertical axis 26 that extends in a vertical direction and lies parallel to the strike face 13, (ii) a heel/toe axis 28 that extends in a horizontal direction and lies parallel to the strike face 13, and (iii) a front/back axis 30 that extends in a horizontal direction and lies perpendicular to the heel/toe axis 28.

The club head 10 has a moment of inertia (i.e., a resistance to twisting) about each of the three axes. Specifically, the club head 10 has a moment of inertia about the vertical axis 26 ("Izz"), a moment of inertia about the heel/toe axis 28 ("Ixx"), and a moment of inertia about the front/back axis 30 ("Iyy).

Forgiveness on a golf shot is generally maximized by configuring the golf club head such that the center of gravity ("CG") of the golf club head is optimally located and the MOI of the golf club head is maximized. Typically, however, the MOI about the z-axis (Izz) and the x-axis (Ixx) is most relevant to club head forgiveness.

A moment of inertia about the golf club head CG x-axis (Ixx) is calculated by the following equation:

$$Ixx=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following equation:

$$Izz=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

It is also informative to define characteristic angles of golf clubs. Referring first to FIGS. 3A-3D, there are shown characteristic angles of golf clubs by way of reference to a golf club head 300 having a shaft 50. The club head 300 comprises a centerface, or striking face, 310, scorelines 320, a hosel 330 having a hosel opening 340, and a sole 350. The hosel 330 has a hosel longitudinal axis 60 and the shaft 50 has a shaft longitudinal axis. In the illustrated embodiment, the ideal impact location 312 of the golf club head 300 is disposed at the geometric center of the striking surface 310. The ideal impact location 312 is typically defined as the intersection of the midpoints of a height (Hss) and width (Wss) of the striking surface 310.

Figure 3A:
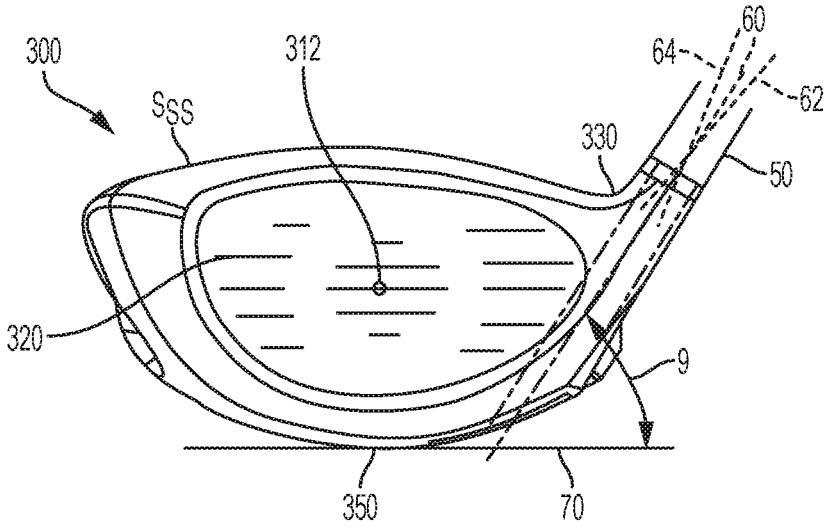
FIG. 3A is a front elevational view of a "metalwood" club-head.

Both Hss and Wss are determined using the striking face curve (Sss). The striking face curve is bounded on its periphery by all points where the face transitions from a substantially uniform bulge radius (face heel-to-toe radius of curvature) and a substantially uniform roll radius (face crown-to-sole radius of curvature) to the body (FIG. 3A). In the illustrated example, Hss is the distance from the periphery proximate the sole portion of Sss to the periphery proximate the crown portion of Sss measured in a vertical plane (perpendicular to ground) that extends through the geometric center of the face. Similarly, Wss is the distance from the periphery proximate the heel portion of Sss to the periphery proximate the toe portion of Sss measured in a horizontal plane (e.g., substantially parallel to ground) that extends through the geometric center of the face. See USGA "Procedure for Measuring the Flexibility of a Golf club head," Revision 2.0 for the methodology to measure the geometric center of the striking face.

As shown in FIG. 3A, a lie angle 9 (also referred to as the "scoreline lie angle") is defined as the angle between the hosel longitudinal axis 60 and a playing surface 70 when the club is in the grounded address position. The grounded address position is defined as the resting position of the head on the playing surface when the shaft is supported at the grip (free to rotate about its axis) and the shaft is held at an angle to the ground such that the scorelines 320 are horizontal (if the club does not have scorelines, then the lie shall be set at 60-degrees). The centerface target line vector is defined as a horizontal vector which is perpendicular to the shaft when the club is in the address position and points outward from the centerface point. The target line plane is defined as a vertical plane which contains the centerface target line vector. The square face address position is defined as the head position when the sole is lifted off the ground, and the shaft is held (both positionally and rotationally) such that the scorelines are horizontal and the centerface normal vector completely lies in the target line plane (if the head has no scorelines, then the shaft shall be held at 60-degrees relative to ground and then the head rotated about the shaft axis until the centerface normal vector completely lies in the target line plane). The actual, or measured, lie angle can be defined as the angle 9 between the hosel longitudinal axis 60 and the playing surface 70, whether or not the club is held in the grounded address position, with the scorelines horizontal. Studies have shown that most golfers address the ball with actual lie angle that is 10 to 20 degrees less than the intended scoreline lie angle 9 of the club. The studies have also shown that for most golfers the actual lie angle at impact is between 0 and 10 degrees less than the intended scoreline lie angle 9 of the club.

Figure 3B:
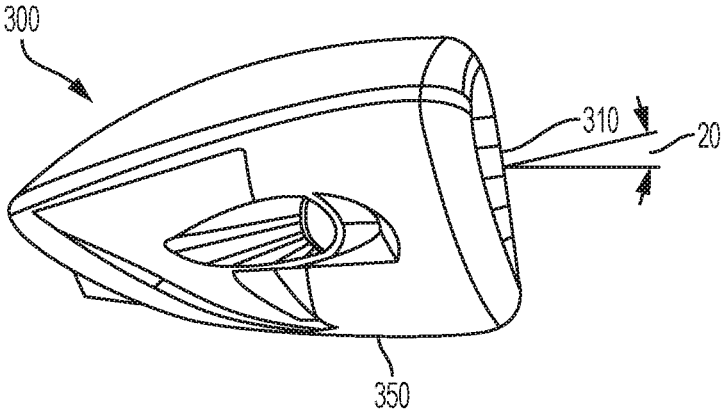
FIG. 3B is a side elevational view of the golf club head of FIG. 3A.

As shown in FIG. 3B, a loft angle 20 of the club head (referred to as "square loft") is defined as the angle between the centerface normal vector and the ground plane 70 when the head is in the square face address position. As shown in FIG. 3D, a hosel loft angle 72 is defined as the angle between the hosel longitudinal axis 60 projected onto the target line plane and a plane 74 that is tangent to the center of the centerface. The shaft loft angle is the angle between plane 74 and the longitudinal axis of the shaft 50 projected onto the target line plane. The "grounded loft" 80 of the club head is the vertical angle of the centerface normal vector when the club is in the grounded address position (i.e., when the sole 350 is resting on the ground), or stated differently, the angle between the plane 74 of the centerface and a vertical plane when the club is in the grounded address position.

Figure 3C:
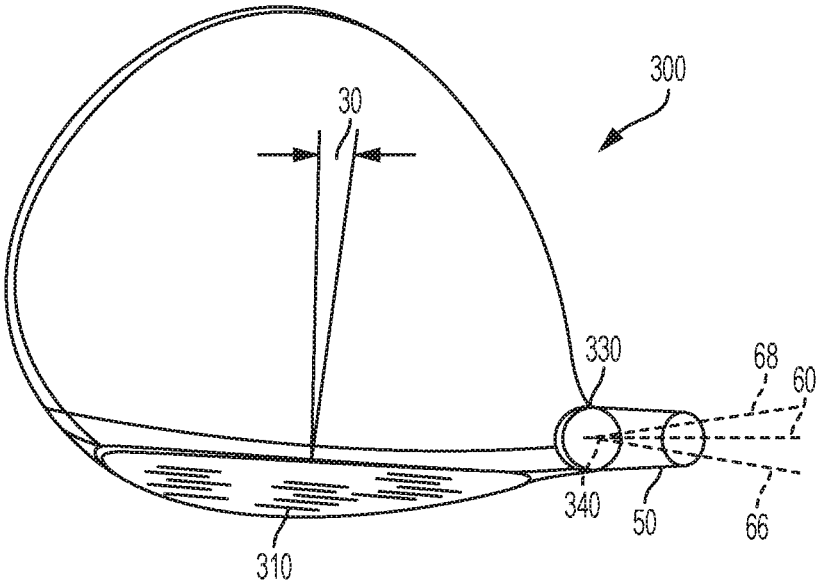
FIG. 3C is a top plan view of the golf club head of FIG. 3A.
Figure 3D:
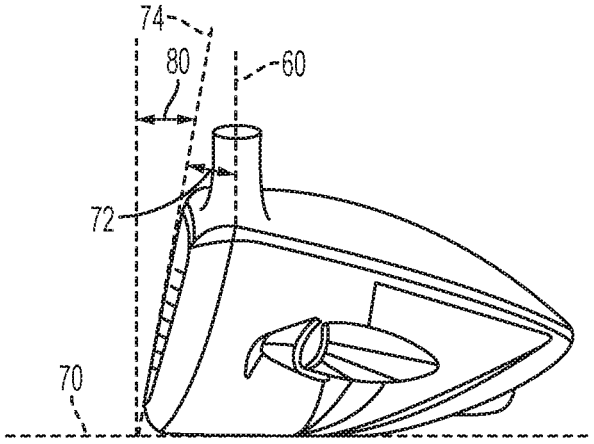
FIG. 3D is a side elevational view of the golf club head of FIG. 3A.

As shown in FIG. 3C, a face angle 30 is defined by the horizontal component of the centerface normal vector and a vertical plane ("target line plane") that is normal to the vertical plane which contains the shaft longitudinal axis when the shaft 50 is in the correct lie (i.e., typically 60 degrees+/−5 degrees) and the sole 350 is resting on the playing surface 70 (the club is in the grounded address position). The lie angle 9 and/or the shaft loft can be modified by adjusting the position of the shaft 50 relative to the club head. Traditionally, adjusting the position of the shaft has been accomplished by bending the shaft and the hosel relative to the club head. As shown in FIG. 3A, the lie angle 9 can be increased by bending the shaft and the hosel inward toward the club head 300, as depicted by shaft longitudinal axis 64. The lie angle 9 can be decreased by bending the shaft and the hosel outward from the club head 300, as depicted by shaft longitudinal axis 62. As shown in FIG. 3C, bending the shaft and the hosel forward toward the striking face 310, as depicted by shaft longitudinal axis 66, increases the shaft loft. Bending the shaft and the hosel rearward toward the rear of the club head, as depicted by shaft longitudinal axis 68, decreases the shaft loft. It should be noted that in a conventional club the shaft loft typically is the same as the hosel loft because both the shaft and the hosel are bent relative to the club head. In certain embodiments disclosed herein, the position of the shaft can be adjusted relative to the hosel to adjust shaft loft. In such cases, the shaft loft of the club is adjusted while the hosel loft is unchanged.

Adjusting the shaft loft is effective to adjust the square loft of the club by the same amount. Similarly, when shaft loft is adjusted and the club head is placed in the address position, the face angle of the club head increases or decreases in proportion to the change in shaft loft. Hence, shaft loft is adjusted to effect changes in square loft and face angle. In addition, the shaft and the hosel can be bent to adjust the lie angle and the shaft loft (and therefore the square loft and the face angle) by bending the shaft and the hosel in a first direction inward or outward relative to the club head to adjust the lie angle and in a second direction forward or rearward relative to the club head to adjust the shaft loft.

Having first defined the main features of a typical "metalwood" club-head, the specific features of the construction of the club heads which utilizes a lightweight material in the golf club head will now be described in more detail.

Figure 4A:
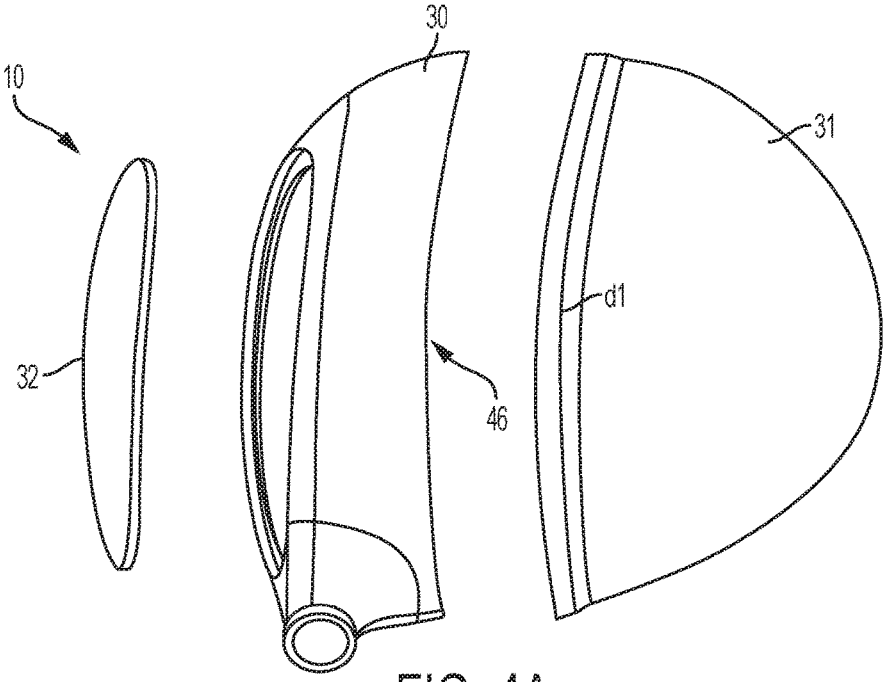
FIG. 4A is an exploded top view of a golf club head in accordance with one embodiment.

In one embodiment as shown in FIG. 4A, the golf club head 10 includes three main components, a frame component 30, a rear cap component, 31 and a striking plate 32. As shown in the cross section view in FIG. 4B, both the frame component 30 and rear cap component, 31, may also have one or more weight ports, for example 33 and 34 respectively, for the placement of discretionary weighting.

In the embodiment of FIG. 4A the rear cap component 31 generally conforms to the shape of the rear of a conventional metalwood golf club head, including either a driver or fairway wood or hybrid club. The rear cap component 31 may comprise a polymeric material, a metal alloy (e.g., an alloy of titanium, an alloy of steel, an alloy of aluminum, and/or an alloy of magnesium), a composite material, such as a graphitic composite, a ceramic material or any combination thereof. If required for strength purposes the material used to prepare the rear cap may be further reinforced by the addition of strengthening fillers or fibers such as carbon fiber, glass fiber or polymeric fibers such as polyaramid. In some embodiments, the rear cap component is made from a transparent or translucent polymeric material.

Any polymeric material used to construct the rear cap component 31 should exhibit high strength and rigidity over a broad temperature range as well as good wear and abrasion behavior and be resistant to stress cracking. Such properties include, a) a Tensile Strength of from about 50 to about 1300 MPa, preferably of from about 150 to about 500 MPa, more preferably of from about 200 to about 400 MPa (as measured by ASTM D 638, or ISO 527);

b) a Tensile Modulus of from about 2 to about 100, preferably of from about 10 to about 80, more preferably of from about 10 to about 70 GPa (as measured by ASTM D 638, or ISO 527);

c) a Flexural Strength from about 50 to about 1000 MPa, more preferably of from about 100 to about 750, even more preferably of from about 150 to about 500 MPa (as measured by ASTM D 790 or ISO 178);

d) a Flexural Modulus of from about 2 to about 120 GPa, more preferably of from about 5 to about 60 GPa, more preferably of from about 15 to about 60 GPa (as measured by ASTM D 790 or ISO 178);

e) a Tensile Elongation of greater than about 1%, preferably greater than about 1.5% even more preferably greater than about 3% as measured by ASTM D 638 or ISO 527.

Exemplary polymers may include without limitation, synthetic and natural rubbers, thermoset polymers such as thermoset polyurethanes or thermoset polyureas, as well as thermoplastic polymers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these most preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers and any and all combinations thereof.

In some embodiments, the rear cap may be formed from a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference in their entirety. The composite material may be manufactured according to the methods described at least in U.S. patent application Ser. No. 11/825,138, the entire contents of which are herein incorporated by reference.

Alternatively, the rear cap component 31 may be formed from short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Figure 4B:
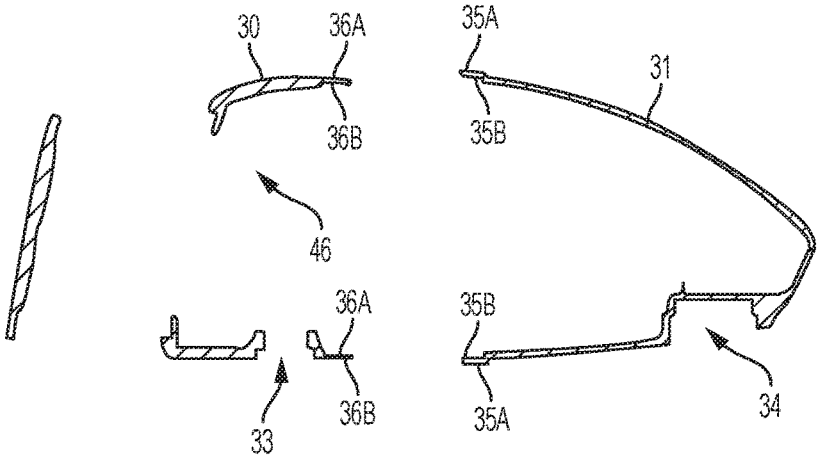
FIG. 4B is a vertical cross sectional view of the golf club head of FIG. 4A.
Figure 4C:
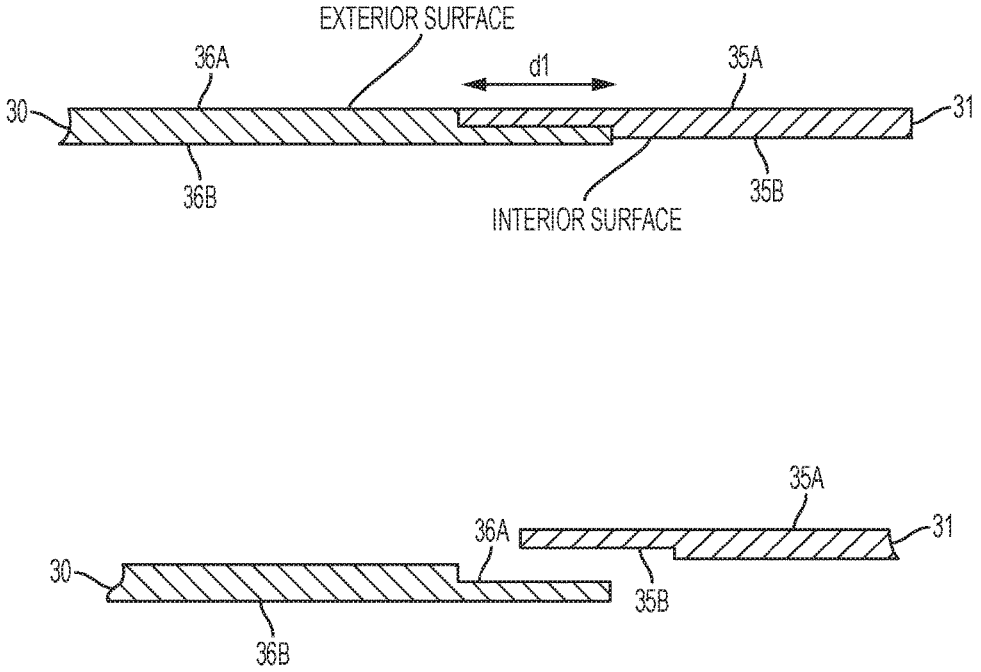
FIG. 4C is a cross section and expanded view of a joint used in one embodiment.
Figure 4D:
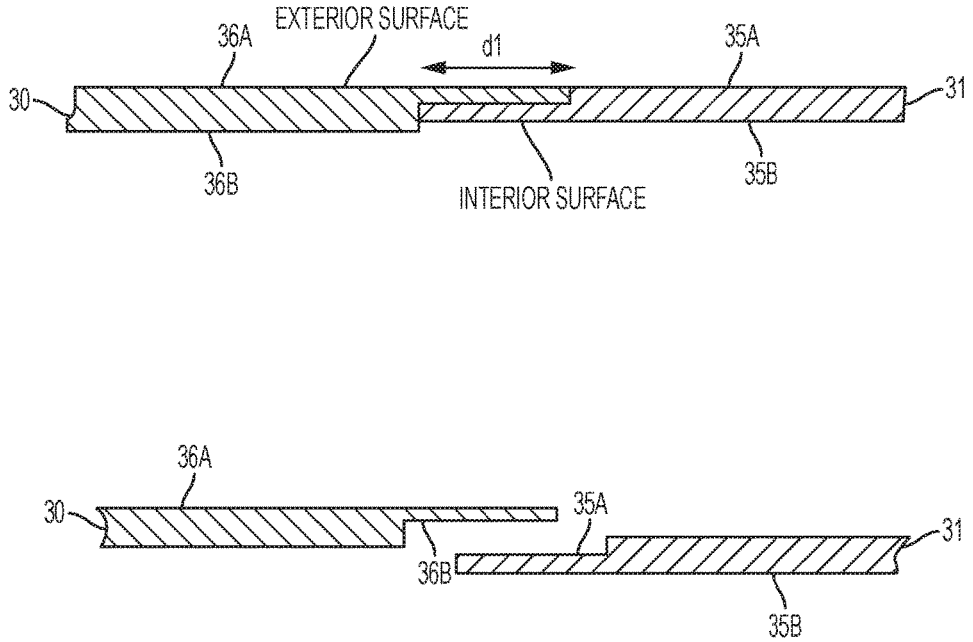
FIG. 4D is a cross section and expanded view of a joint used in one embodiment.
Figure 4E:
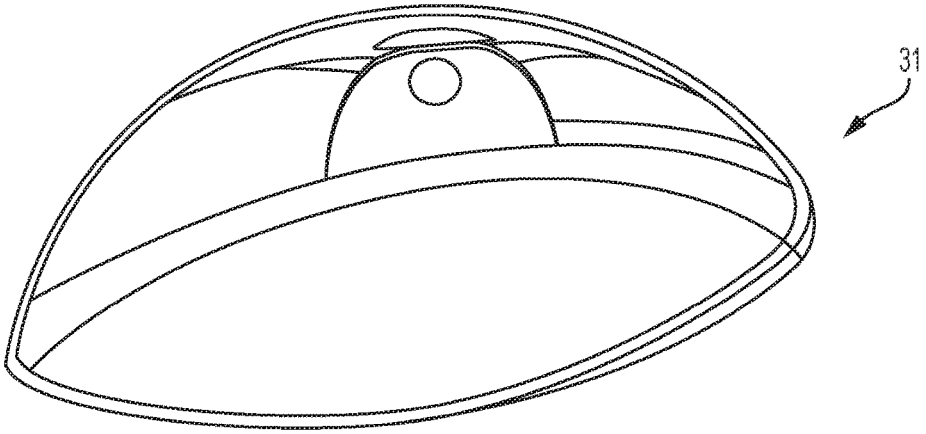
FIG. 4E is a bottom view of a rear cap component used in one embodiment.
Figure 4F:
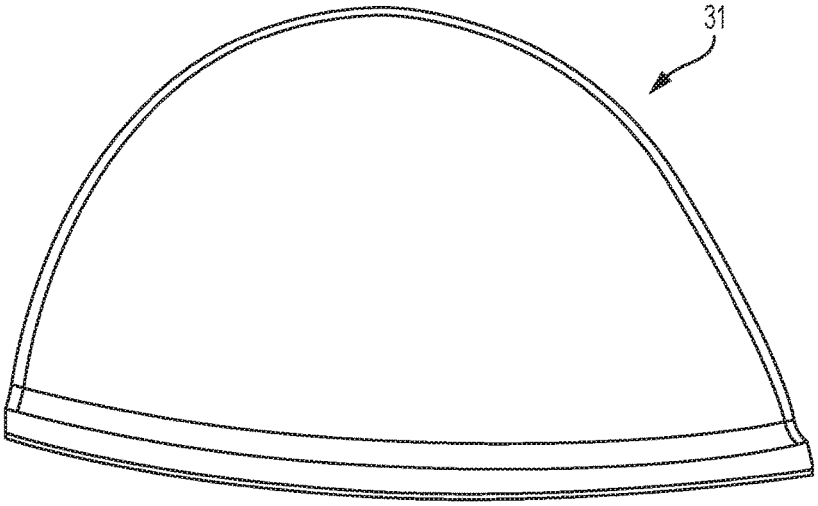
FIG. 4F is a top view of a rear cap component used in one embodiment.
Figure 4G:
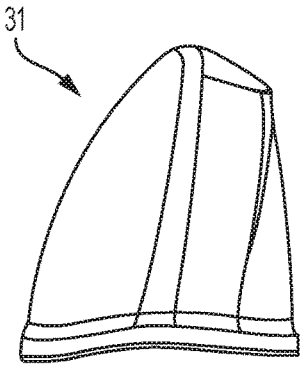
FIG. 4G a side view of a rear cap component used in one embodiment.
Figure 4H:
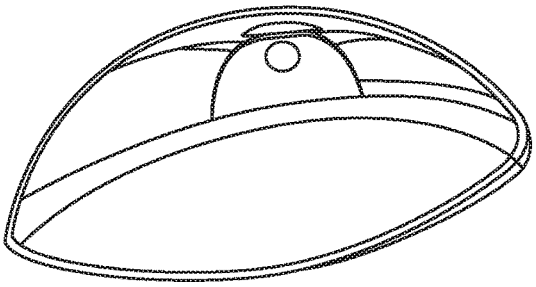
FIG. 4H is a bottom view of the outer layer of a rear cap component used in one embodiment.
Figure 4I:
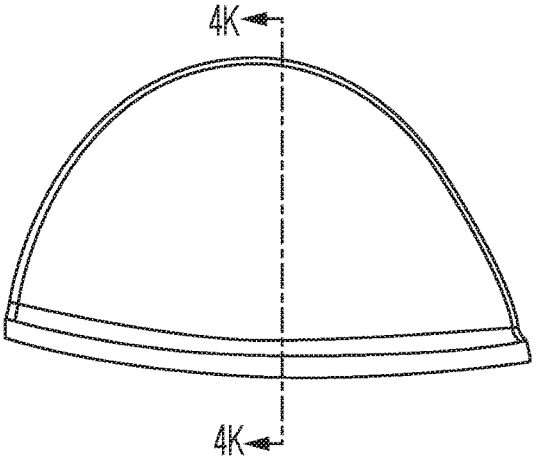
FIG. 4I is a top view of the outer layer of a rear cap component used in one embodiment.
Figure 4J:
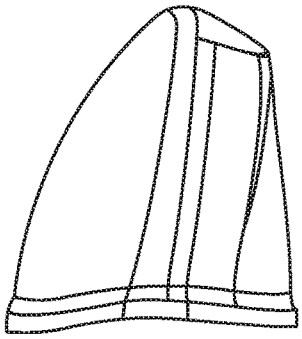
FIG. 4J is a side view of the outer layer of a rear cap component used in one embodiment.
Figure 4K:
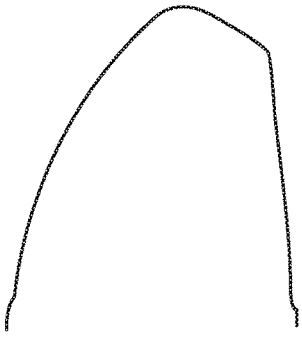
FIG. 4K is a is a cross sectional schematic view of the outer layer of a rear cap component used in one embodiment taken in the plane indicated by line 4K-4K of FIG. 4I.
Figure 4M:
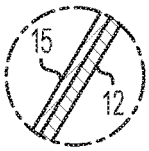
FIG. 4M is a detail view of a crown portion in FIG. 4L.
Figure 4L:
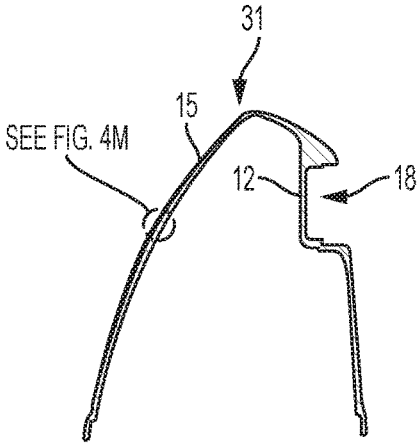
FIG. 4L is a vertical cross sectional view.

In an especially preferred embodiment, as shown in FIGS. 4L and 4M, the rear cap component 31 is formed as a two layered structure comprising an injection molded inner layer 12 and an outer layer 15 comprising a thermoplastic composite laminate. The injection molded inner layer may be prepared from the thermoplastic polymers as described previously for use in forming the rear cap component, with preferred materials including a polyamide (PA), or thermoplastic urethane (TPU) or a polyphenylene sulfide (PPS) and their short or long fiber reinforced formulations. Typically the thermoplastic composite laminate structures used to prepare the outer layer 15 are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA66), polypropylene (PP), thermoplastic polyurethane or polyureas (TPU) and polyphenylene sulfide (PPS).

The laminates may be formed in a process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered rear cap component 31 shown in the differing perspectives in FIGS. 4E, 4F and 4G may be formed. In some embodiments the outer layer 15, is formed separately and discretely from the forming of the injection molded inner layer 12. The outer layer 15 may be formed using known techniques for shaping thermoplastic composite laminates into parts including but not limited to compression molding or rubber and matched metal press forming or diaphragm forming.

The inner layer 12 may be injection molded using conventional techniques and secured to the outer crown layer 15 by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer 12 is secured to the outer layer 15, the outer surface of the inner layer 12 and/or the inner surface of the outer layer 15 may be pretreated by means of one or more of the following processes (disclosed in more detail in Ehrenstein, "Handbuch Kunststoff-Verbindungstechnik", Carl Hanser Verlag Munich 2004, pages 494-504):

Mechanical treatment, preferably by brushing or grinding,
Cleaning with liquids, preferably with aqueous solutions or organics solvents for removal of surface deposits
Flame treatment, preferably with propane gas, natural gas, town gas or butane
Corona treatment (potential-loaded atmospheric pressure plasma)
Potential-free atmospheric pressure plasma treatment
Low pressure plasma treatment (air and 02 atmosphere)
UV light treatment
Chemical pretreatment, e.g. by wet chemistry by gas phase pretreatment
Primers and coupling agents In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part as shown in the FIG. 4H, 4I, 4J and in the cross sectional view of FIG. 4K. During injection molding, the thermoplastic material of the inner layer 12 is then molded to the inner surface of the composite laminate structure the materials fuse together to form the rear cap 31 as a highly integrated part. Typically the injection molded inner layer 12 is prepared from the same polymer family as the matrix material used in the formation of the composite laminate structures used to form the outer layer 15, so as to ensure a good weld bond.

In addition to being formed in the desired shape for the aft body of the club head, the thermoplastic inner layer 12 may also be formed with additional features including one or more stiffening ribs to impart strength and/or desirable acoustical properties as well as one or more weight ports 18 as shown in FIG. 4L, to allow placement of additional tungsten (or other metal) weights.

The thickness of the inner layer is typically of from about 0.25 to about 2 mm, preferably of from about 0.5 to about 1.25 mm, although as shown in FIG. 4L it may be considerably thicker at areas which also form a weight port 18.

The thickness of the composite laminate structure used to form the outer layer 15 is typically of from about 0.25 to about 2 mm, preferably of from about 0.5 to about 1.25 mm, even more preferably from 0.5 to 1 mm.

The frame and the rear cap component when connected collectively define an outer envelope and enclose an internal volume of the club head.

Figure 6A:
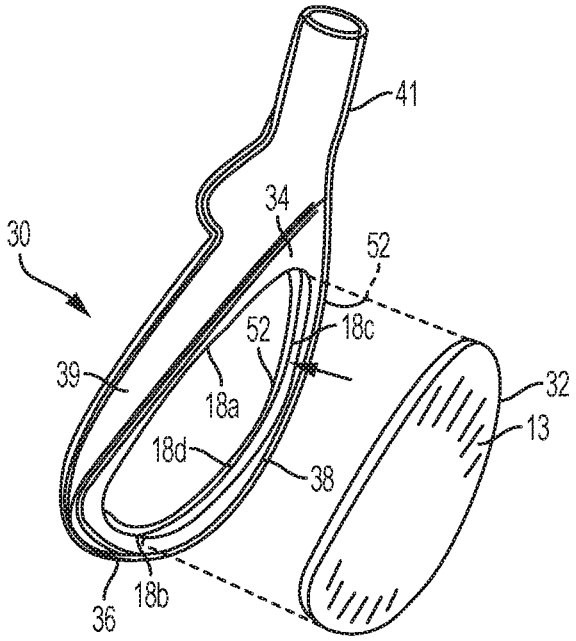
FIG. 6A is an a exploded view of the frame component and a striking face of a golf club head in accordance with one embodiment.

As shown in FIG. 6A and in various embodiments the frame component 30 has a frame heel 34, a frame toe 36, a frame sole 38, a frame crown 39 and a frame hosel 41 for attaching the shaft. The frame component 30 can function as the main support structure for the club head and thus supports the main load on impact with the golf ball. It is thus desirable that the frame be made from a strong lightweight material which can include either metal or a composite material or a polymeric material and any and all combinations thereof or subcomponents prepared therefrom. In some embodiments the frame component 30 may be prepared from the same polymeric material used to prepare the rear cap component 31, including the short or long fiber-reinforced formulations of the previously referenced polymers, as well as the previously described composite laminate materials Preferably the frame is made of a metal such as titanium or titanium alloys including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075).

Other metals which may be used to construct the frame component may include steels or alloys of steel, or any other metal or metal alloy commonly used in golf club head construction including magnesium alloys, copper alloys, and nickel alloys. Preferably, the frame component comprises a forged aluminum component such aluminum alloy 7075, which is an aluminum alloy with zinc as the primary alloying element. It is strong, with strength comparable to many steels, and has good fatigue strength and average machinability, but has less resistance to corrosion than many other Al alloys. Its relatively high cost limits its use to applications where cheaper alloys are not suitable. The 7075 aluminum alloy's composition includes (in addition to aluminum) 5.6-6.1 wt % zinc, 2.1-2.5 wt % magnesium, 1.2-1.6 wt % copper, and less than half a percent y weight of silicon, iron, manganese, titanium, chromium, and other metals. It is produced in many tempers, one preferred temper is T6. T6 temper 7075 has an ultimate tensile strength of 74,000-78,000 psi (510-572 MPa) and yield strength of at least 63,000-69,000 psi (434-503 MPa). It has a failure elongation of 5-11%. The T6 temper is usually achieved by homogenizing the cast 7075 at 450° C. for several hours, and then ageing at 120° C. for 24 hours. This yields the peak strength of the 7075 alloy. The strength is derived mainly from finely dispersed eta and eta' precipitates both within grains and along grain boundaries.

The frame component 30 may be prepared by investment-casting as a single unit using a casting shell that defines details both in the cavity and on the outside of the body. Alternatively the frame component 30 may be prepared as a forged structure. In addition to casting or forging, the frame component 30 may be prepared by any method for preparing club head components commonly used in the golf industry or new methods for preparing club head components, including (depending on the materials) but not limited to, bladder molding, injection molding, metal-injection-molding, stamping, forming, machining, powdered metal forming, electrochemical milling, thermoforming and any and all combinations thereof.

Figure 5A:
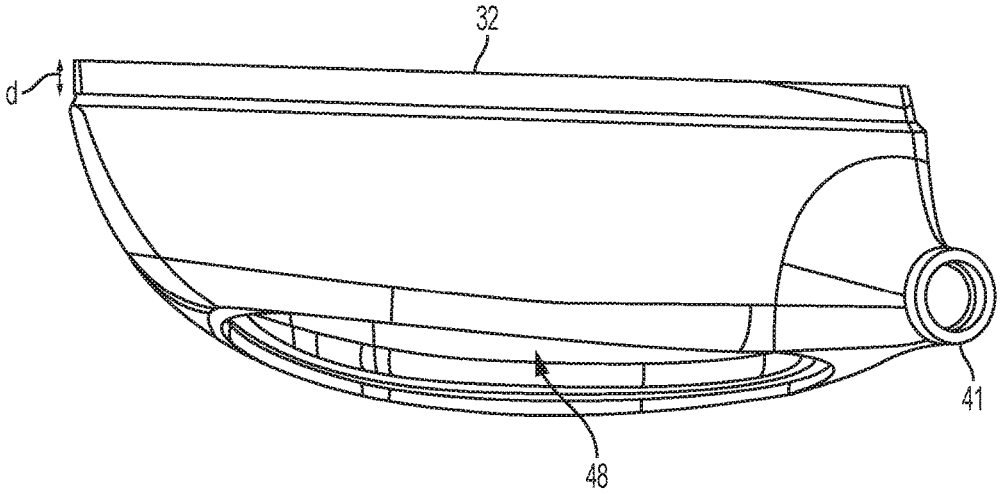
FIG. 5A is a top view of the frame component of a golf club head in accordance with one embodiment.
Figure 5B:
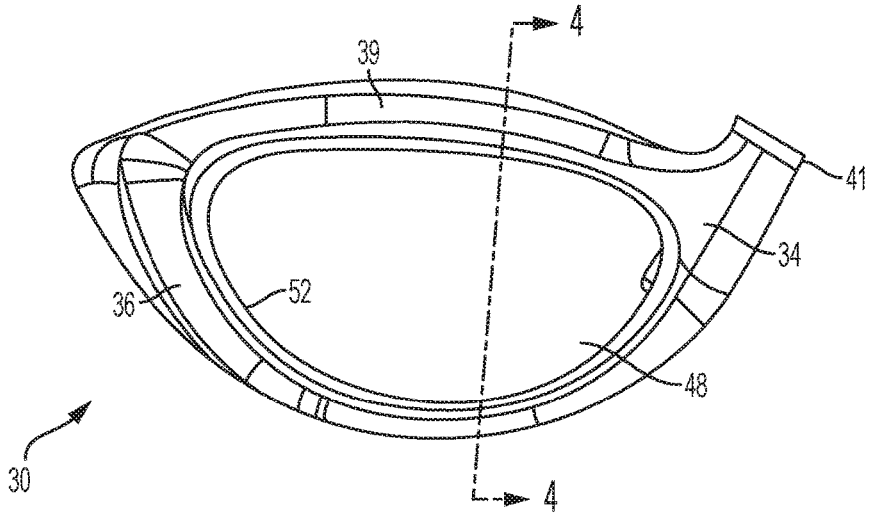
FIG. 5B is a front view of the frame component of a golf club head in accordance with one embodiment.
Figure 5C:
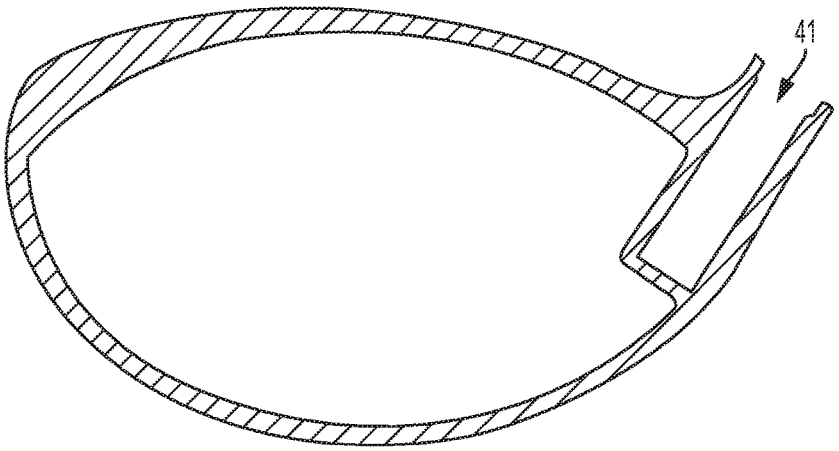
FIG. 5C is a vertical cross sectional view of the frame component of a golf club head in accordance with one embodiment.
Figure 5D:
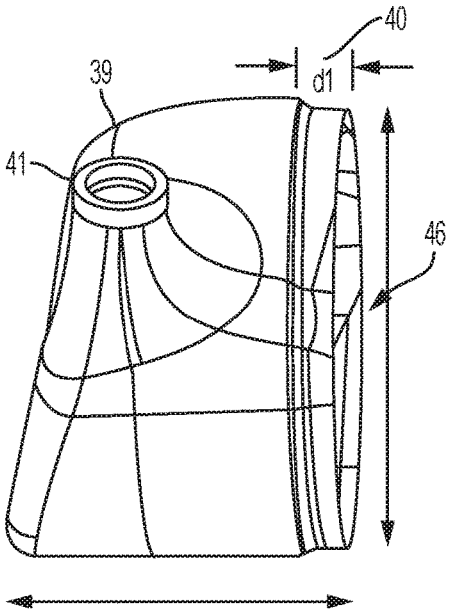
FIG. 5D is a side elevational view of the frame component of a golf club head in accordance with one embodiment.
Figure 5E:
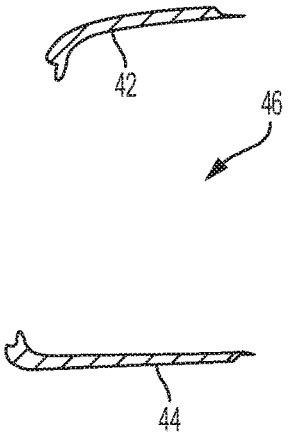
FIG. 5E is a vertical cross sectional view of the line 4-4 of FIG. 5B.
Figure 5F:
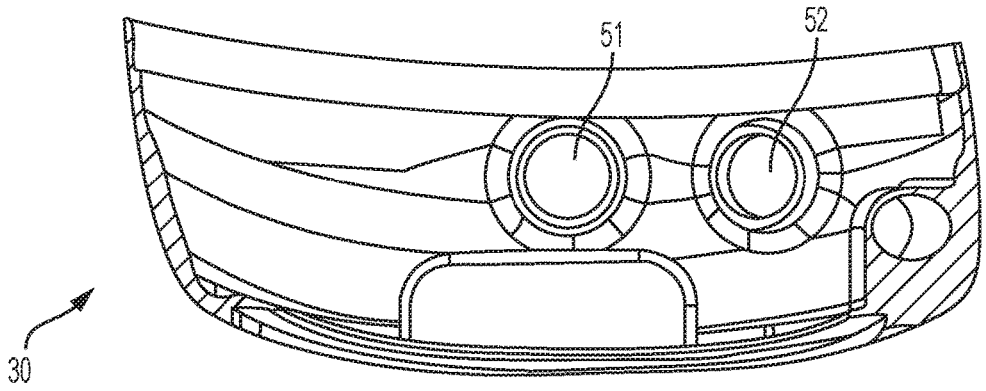
FIG. 5F is a bottom view of the frame component of a golf club head in accordance with one embodiment.

As shown in FIG. 5F in some embodiments, additional weighting can be incorporated in various parts of the frame component 30 to allow the performance of the golf club to be tuned as desired. For example, the frame component 30 may have integral sole weight pads cast into the frame at predetermined locations which can be used to lower, to move forward, to move rearward or otherwise to adjust the location of the club head's center-of-gravity. Also, epoxy can be added to the interior of the frame component 30 through the club head's hosel opening to obtain a desired weight distribution. Alternatively, weights formed of high-density materials can be attached the frame component 30. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Figure 5G:
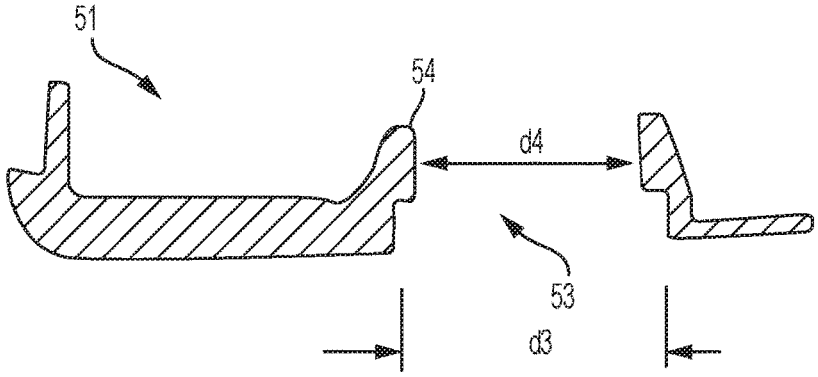
FIG. 5G is an exploded cross sectional view of the weight port assembly 51 of FIG. 5F.

FIG. 5F shows placement of two fixed weight ports in the form of recesses 51 and 52 to allow for placement of two additional weights, on frame component 30. As shown in the expanded view in FIG. 5G the recesses are each defined by an outer recess wall which defines an outer opening 53 having a diameter d3 which can be greater than about 5 mm, preferably greater than about 8 mm, more preferably greater than about 12 mm, even more preferably greater than about 15 mm, and an inner opening 54 having a smaller diameter d4 which can be greater than about 5 mm, preferably greater than about 8 mm, more preferably greater than about 12 mm, even more preferably greater than about 15 mm. This configuration allows the placement of a weight which allows the weight when inserted to have its outer surface flush with the outer surface of the club head. In some embodiments recesses 51 and 52 may define a threaded opening for attachment of the weights. The threaded opening is configured to secure the threaded bodies of the weights but also may be user-replaceable. Although two weight ports are shown in the embodiment in FIG. 5F, other embodiments may contain a fewer greater number of weight ports as desired.

In some embodiments so called movable weights which can be adjusted by the manufacturer and the user to adjust the position of the center of gravity of the club to give the desired performance characteristics can be used in the frame component 30. This feature is described in more detail in the following U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein.

The weight ports can have any of a number of various configurations to receive and retain any of a number of weights or weight assemblies. The weights may have a weight of from about 1 to about 25 grams. In some embodiments a combination of lighter weights having a weight of from about 1 to about 3 grams and heavier weights having a weight of from about 6 to about 18 grams are used. Varying placement of the weights enables the golfer to vary launch conditions in the club head, for optimum distance and accuracy. More specifically, the golfer can adjust the position of the club head's center of gravity, for greater control over the characteristics of launch conditions and, therefore, the trajectory and shot shape of the golf ball.

In some embodiments the frame component 30 may also include a slidably repositionable weight. Among other advantages, a slidably repositionable weight facilitates the ability of the end user of the golf club to adjust the location of the CG of the club head over a range of locations relating to the position of the repositionable weight. This feature is described in more detail in U.S. Pat. Nos. 7,775,905 and 8,444,505 and U.S. patent application Ser. No. 13/898,313 filed on May 20, 2013 and U.S. patent application Ser. No. 14/047,880 filed on Oct. 7, 2013 both in the name of Taylor Made Golf Co. Inc., the entire contents of each of which are hereby incorporated by reference herein as well the contents paragraphs [430] to [470] and FIGS. 93-101 of US Patent Publication No. 2014/0080622 (corresponding to U.S. patent application Ser. No. 13/956,046 filed on Jul. 31, 2013 in the name of Taylor Made Golf Co. Inc., the contents of which are hereby incorporated by reference herein.

The rear cap component 31 is securely connected along a front surface thereof to a surface on the frame portion 30 which extends laterally rearward. This connection may be in the form of a bonded overlay joint, a full lap joint or a half lap joint. As shown in FIG. 4B, there is an abutment surface on the rear cap component 31 having an outer surface 35A and an inner surface 35B and a corresponding abutment surface on the frame component 30 which has an outer surface 36A and an inner surface 36B.

As shown in FIG. 4B this connection may involve an overlay bonding where the inner or interior abutment surface 35B of the rear cap component 31 is overlaid and bonded to the outer or exterior abutment surface 36A of the frame component 30, or alternatively an overlay bonding where the inner or interior abutment surface 36B of the frame component 30, is overlaid and bonded to the outer or exterior abutment surface 35A of the rear cap component 31. Typically the degree of overlay of the overlay joint is of from about 1 to about 20 mm, preferably of from about 4 to about 8 mm, more preferably of from about 5 to about 7 mm.

As shown in FIGS. 5D and 5E, in some embodiments the connection between the rear cap component 31 and the frame portion 30 can also be between an extension portion on the frame which includes an upper lateral section 42 which extends on both the heel and toe side to a lower lateral section 44, and thereby the extension portion encircles and defines a rear opening 46 of the frame portion.

As shown in the expanded view in FIG. 4C showing exploded and joined views, this connection may also involve a half lap joint bonding interaction between the outer or exterior abutment surface 36A of the frame component 30 and the inner or interior abutment surface 35B of the rear cap component 31.

Alternatively as shown in the expanded view in FIG. 4D showing exploded and joined views, this connection may also involve a half lap joint bonding interaction between the inner or interior abutment surface 36B of the frame component 30 and the outer or exterior abutment surface 35A of the rear cap component 31.

Typically the degree of overlap of the lap joint (corresponding to the distance d1 in FIGS. 4B-4D) is of from about 1 to about 20 mm, preferably of from about 4 to about 8 mm, more preferably of from about 5 to about 7 mm.

Figure 5H:
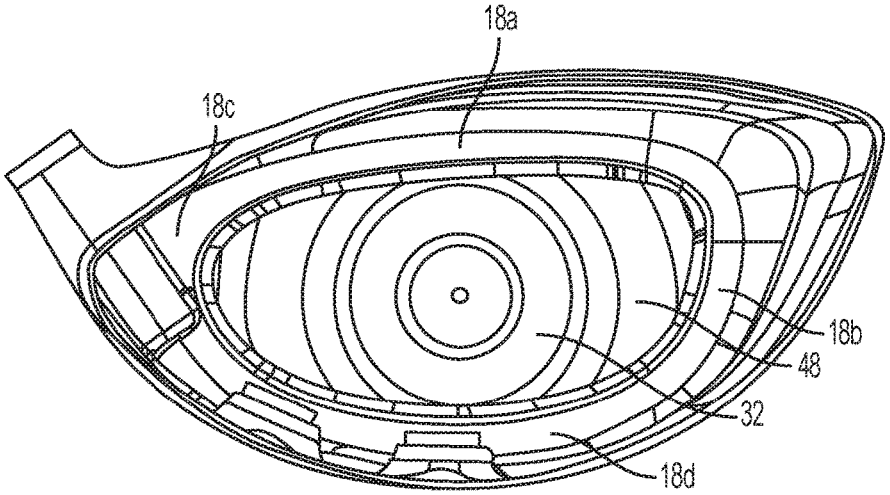
FIG. 5H is a front view of a golf club head in accordance with one embodiment.
Figure 5I:
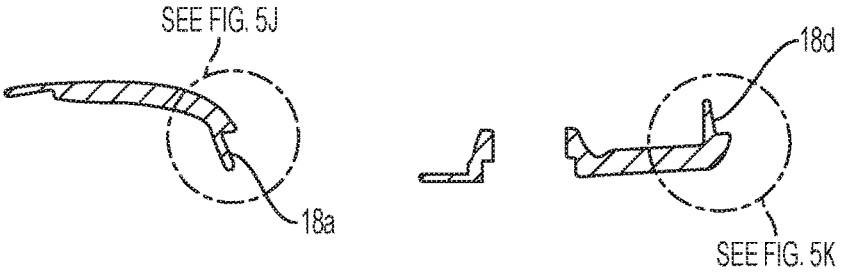
FIG. 5I is a cross sectional view of the front of a golf club head in accordance with one embodiment.
Figure 5J:
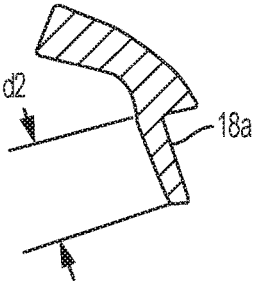
FIG. 5J is an enlarged view of a portion of FIG. 5I.
Figure 5K:
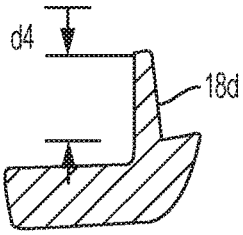
FIG. 5K is an enlarged view of another portion of FIG. 5I.

Referring further to FIGS. 5B and 6A, the walls of the frame portion 30 further define a forwardly facing front opening 48 which includes a lip or transition zone 52 which acts as a face support which is structured to provide ample surface area for receiving the striking plate 32, thereby aiding in club durability. The face support or transition zone 52 is recessed, allowing the striking plate 32 (strike surface) to be flush with the forward wall of the body, and extends along the respective forward edges of the frame heel 34, a frame toe 36, and a frame sole 38 and a frame crown 39. The transition zone 52 effectively is a transition from the front facing walls of the frame 30 to the face plate or strike plate 32. The opening 48 receives the strike plate 32, which rests upon and is bonded to the transition zone 52, thereby enclosing the front opening 48. As shown in FIGS. 5H and 6A, the transition zone 52 includes a sole-lip region 18*d*, a crown-lip region 18*a*, a heel-lip region 18*c*, and a toe-lip region 18*b*. Typically the width of the transition zone as represented by the expanded view in FIG. 5I is about the same in the crown-lip region 18*a* and the sole-lip region 18*d*. As shown in FIG. 5J, the crown-lip region 18*a* has a width d2 which may be of from about 1 to about 12 mm, preferably of from about 3 to about 8 mm, more preferably of from about 4 to about 6 mm. As shown in FIG. 5K the sole-lip region 18*d* has a width d4 which may be of from about 1 to about 12 mm, preferably of from about 3 to about 8 mm, more preferably of from about 4 to about 6 mm.

Figure 5L:
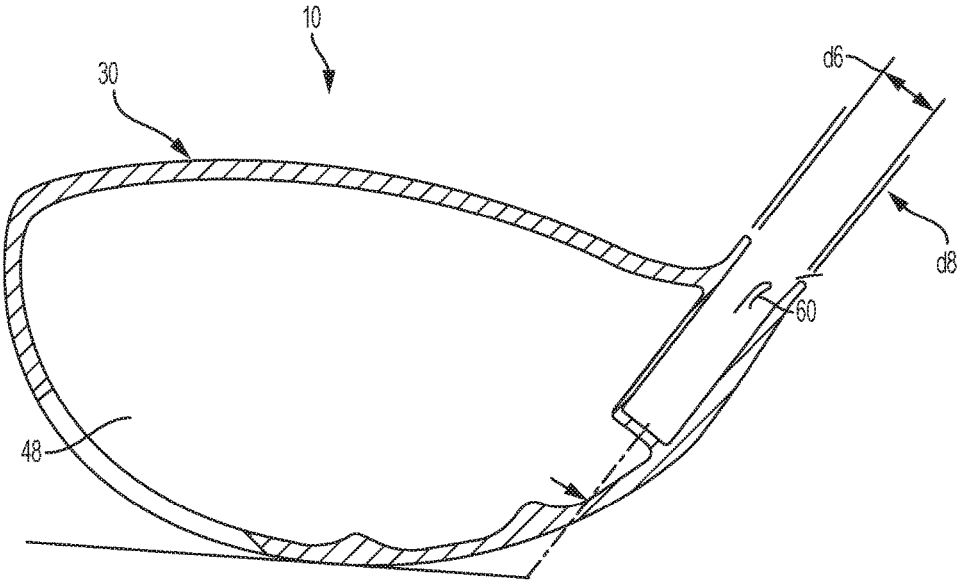
FIG. 5L is a cross sectional view of a golf club head in accordance with one embodiment.

Now referring to FIG. 5L, the walls of the frame portion 30 further define a hosel opening 60 which has an inner diameter d6 and an outer diameter d8 to allow for insertion of the golf club shaft. In one embodiment, the shaft is bonded to the club head via the hosel and the hosel has inner diameter d6 is of from about 8 to about 12 mm and preferably of from about 9 to about 11 mm and the outer diameter d8 is of from about 10 to about 14 mm and preferably of from about 11 to about 13 mm. In some embodiments the shaft hosel assembly may employ a removable head-shaft connection assembly which may also incorporate features that provide the golf club heads and/or golf clubs with the ability to adjust the loft and/or the lie angle of the club as described in more detail below.

As shown in the exploded view of FIG. 6A the strike plate 32 is fitted to the corresponding front opening 48 of the frame portion. The strike plate 32 can be made of the same material as the frame or of a different material. If the materials are metallic, the strike plate 32 can be made by casting, rolling, stamping, forging, machining, or other suitable method and can be welded to the body. Otherwise, the strike plate 32 can be bonded to the body using adhesive or by other suitable method. The strike plate 32 normally has some degree of outwardly facing convexity, and this convexity is frequently of a complex-curvature nature. Typically, the striking face 32 has both a heel-to-toe convex curvature (referred to as "bulge") and a crown-to-sole convex curvature (referred to as "roll").

In certain embodiments, a variable thickness face profile is implemented according to U.S. patent application Ser. No. 12/006,060, U.S. Pat. Nos. 6,997,820, 6,800,038, and 6,824,475, which are incorporated herein by reference in their entirety. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for re-allocation to another area of the club head.

Figure 6B:
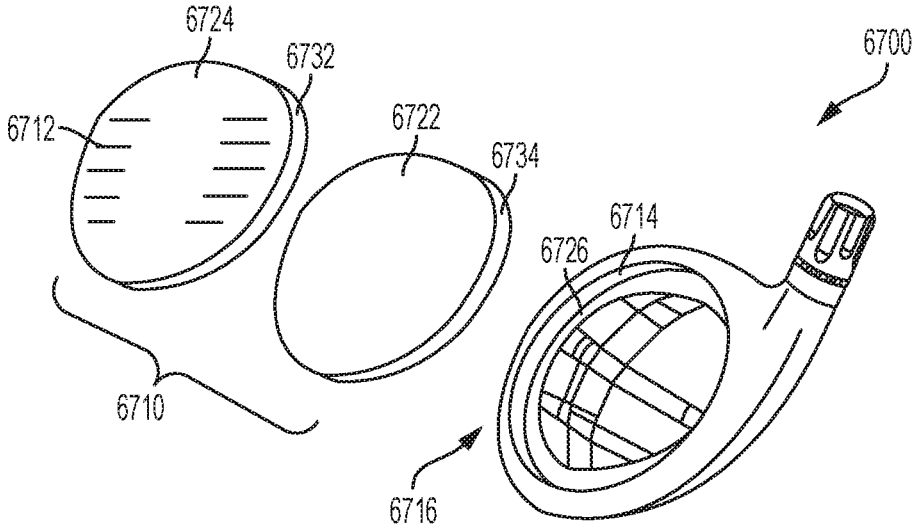
FIG. 6B is an a exploded view of the frame component and a striking face and a polymer endcap of a golf club head in accordance with one embodiment.
Figure 6C:
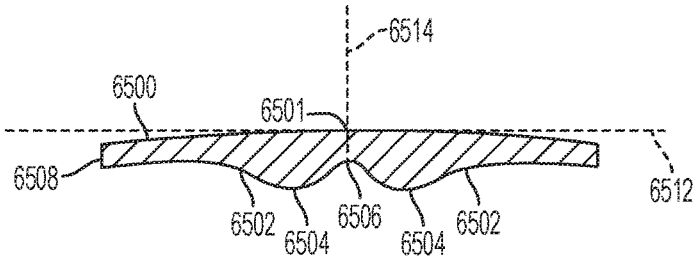
FIG. 6C is a cross sectional view of a striking face.
Figure 6D:
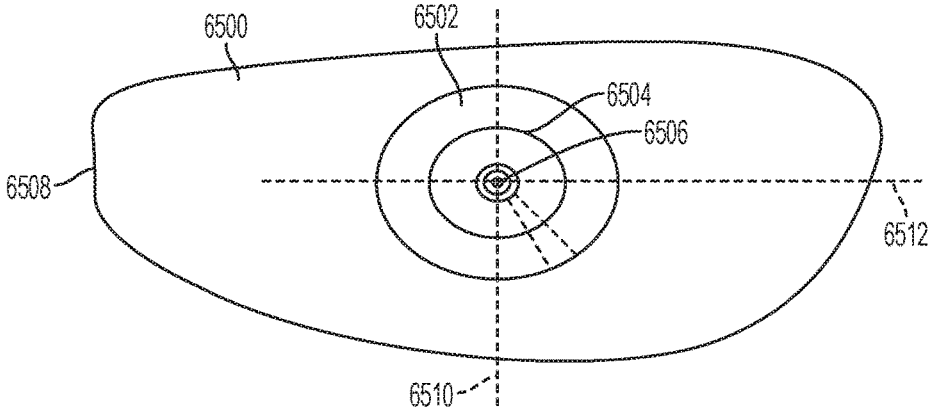
FIG. 6D is a rear elevation view of a striking face.

A variable thickness face plate 6500, according to one embodiment of a golf club head illustrated in FIGS. 6C and 6D, includes a generally circular protrusion 6502 extending into the interior cavity towards the rear portion of the golf club head. When viewed in cross-section, as illustrated in FIG. 6C, protrusion 6502 includes a portion with increasing thickness from an outer portion 6508 of the face plate 6500 to an intermediate portion 6504. The protrusion 6502 further includes a portion with decreasing thickness from the intermediate portion 6504 to an inner portion 6506 positioned approximately at a center of the protrusion preferably proximate the golf club head origin. An origin x-axis 6512 and an origin z-axis 6510 intersect near the inner portion 6506 across an x-z plane. However, the origin x-axis 6512, origin z-axis 6510, and an origin y-axis 6514 pass through an ideal impact location 6501 located on the striking surface of the face plate. In certain embodiments, the inner portion 6506 can be aligned with the ideal impact location with respect to the x-z plane.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm. The face thickness should have a thickness change of at least 25% over the face (thickest portion compared to thinnest) in order to save weight and achieve a higher ball speed on off-center hits.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

In other embodiments the face plate 32 is made of a composite including multiple plies or layers of a fibrous material (e.g., graphite, or carbon, fiber) embedded in a cured resin (e.g., epoxy). An exemplary thickness range of the composite portion of the face plate is 8.0 mm or less. Composite face plates for use in the metalwood golf clubs may be fabricated using the procedures described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference in their entirety. The composite material can be manufactured according to the methods described at least in U.S. patent application Ser. No. 11/825,138, the entire contents of which are herein incorporated by reference in their entirety.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of g/m") FAW values below 200 g/rrr', preferably below 100 g/rrr' and more preferably below 70 g/rn", can be particularly effective. A particularly suitable fibrous material for use in making prepreg plies is carbon fiber, as noted.

The composite desirably is configured to have a relatively consistent distribution of reinforcement fibers across a cross-section of its thickness to facilitate efficient distribution of impact forces and overall durability. In addition, the thickness of the face plate 32 can be varied in certain areas to achieve different performance characteristics and/or improve the durability of the club-head. The face plate 32 can be formed with any of various cross-sectional profiles, depending on the club-head's desired durability and overall performance, by selectively placing multiple strips of composite material in a predetermined manner in a composite lay-up to form a desired profile.

Texture can be incorporated into the surface of the tool used for forming the composite plate, thereby allowing the textured area to be controlled precisely and automatically. For example, in an embodiment having a composite plate joined to a cast body, texture can be located on surfaces where shear and peel are dominant modes of failure. Methods of introducing such texture are more fully disclosed in copending U.S. application Ser. No. 11/960,609 filed on Dec. 1, 2007, Ser. No. 13/111,715 filed on May 19, 2011 and Ser. No. 13/728,683 filed on 27 Dec. 2012, the entire contents of each of which are incorporated herein by reference in their entirety.

Typically the final part is sized larger than the intended final size and after reaching full-cure, the components are subjected to manufacturing techniques (machining, forming, etc.) that achieve the specified final dimensions, size, contours, etc., of the components for use as face plates on club-heads. These techniques are described in more detail in U.S. Pat. No. 7,874,937, the entire contents of which are incorporated by reference herein in their entirety.

In one embodiment, indicia including alignment aids or additional color contrasts or images may be printed on the composite face plate using pad printing or other techniques which are described more fully in U.S. Application No. 61/792,529 filed on Mar. 15, 2013, the entire contents of which are incorporated herein by reference in their entirety.

In one embodiment, the face plate can then be covered or coated with a protective outer coating (also referred to herein as a "polymer end cap") which covers the composite face plate. The polymer end cap will protect the face from abrasion caused by an impact and general day-to-day use (dropping the club etc.). A polymer end cap also can reduce or eliminate deterioration of the surface finish of the club face caused by sand from the golf ball. The polymer end cap is made from a polymer and can include a textured or roughened surface. The polymeric materials and polymer end cap for use in the golf clubs of the present are more fully described in copending US Publication No. 2009/0163291A1, filed on Dec. 19, 2007, and US Publication No. 2012/0172143A1, filed on Dec. 19, 2011, the entire contents of each of which are incorporated by reference herein in their entirety.

FIG. 6B illustrates an exploded assembly view of the golf club head 6700 and a face insert 6710 including a composite face insert 6722 and a polymer cap 6724. In certain embodiments, the polymer cap 6724 is formed from a thermoset polyurethane or a thermoset polyurea. In some embodiments, the polymer cap 6724 includes a rim portion 6732 that covers a portion of a side wall 6734 of the composite insert 6722.

In other embodiments, the polymer cap 6724 does not have a rim portion 6732 but includes an outer peripheral edge that is substantially flush and planar with the side wall 6734 of the composite insert 6722. A plurality of score lines 6712 can be located on the polymer cap 6724. The composite face insert 6710 may have a variable thickness and is adhesively or mechanically attached to the insert lip or ear 6726 located within the front opening of the frame portion and connected to the frame portion's front opening inner wall 6714. The insert ear 6726 and the composite face insert 6710 can be of the type described in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety.

The foregoing materials, methods, construction and variable thickness face insert are illustrated in an exemplary embodiment shown in FIGS. 7A-7H having i) a frame component 2 having a weight of less than about 110 g, preferably less than about 100 g, more preferably less than about 90 g; ii) a rear cap component 4 having a weight of less than about 50 g, preferably less than about 40 g, more preferably less than about 30 g, and a striking face 3 having a weight of less than about 50 g, preferably less than about 40 g, more preferably less than about 30 g.

Figure 7A:
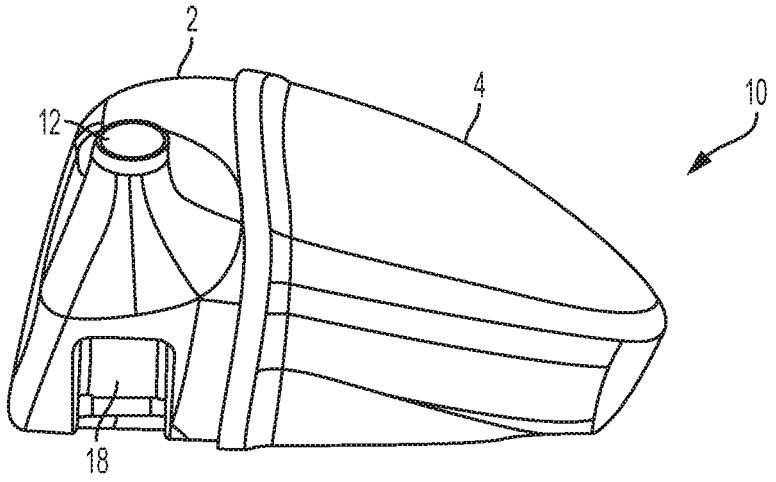
FIG. 7A is a side view of a golf club head in accordance with one embodiment.
Figure 7B:
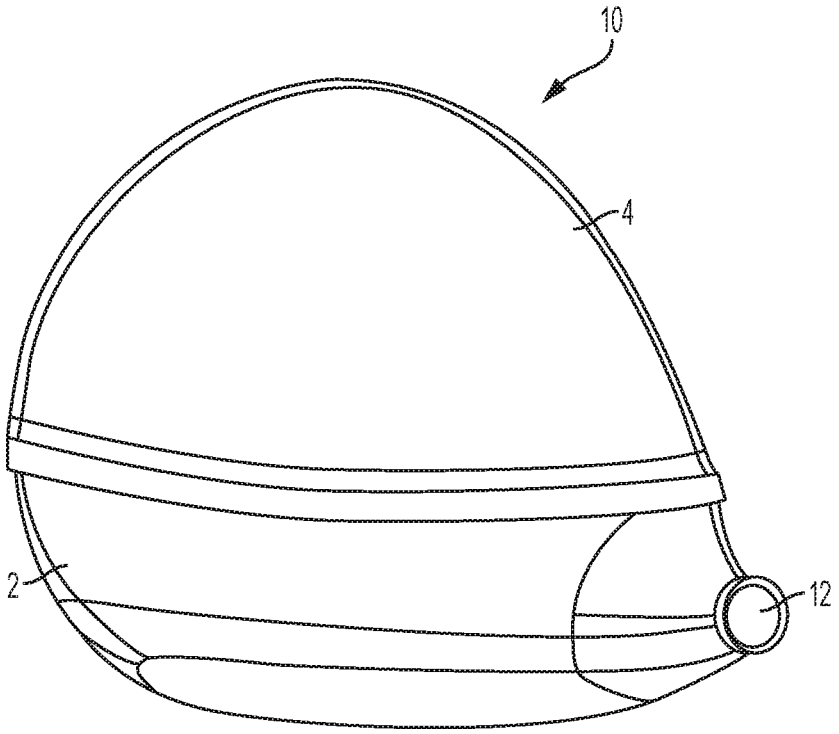
FIG. 7B is a top view of a golf club head in accordance with one embodiment.
Figure 7C:
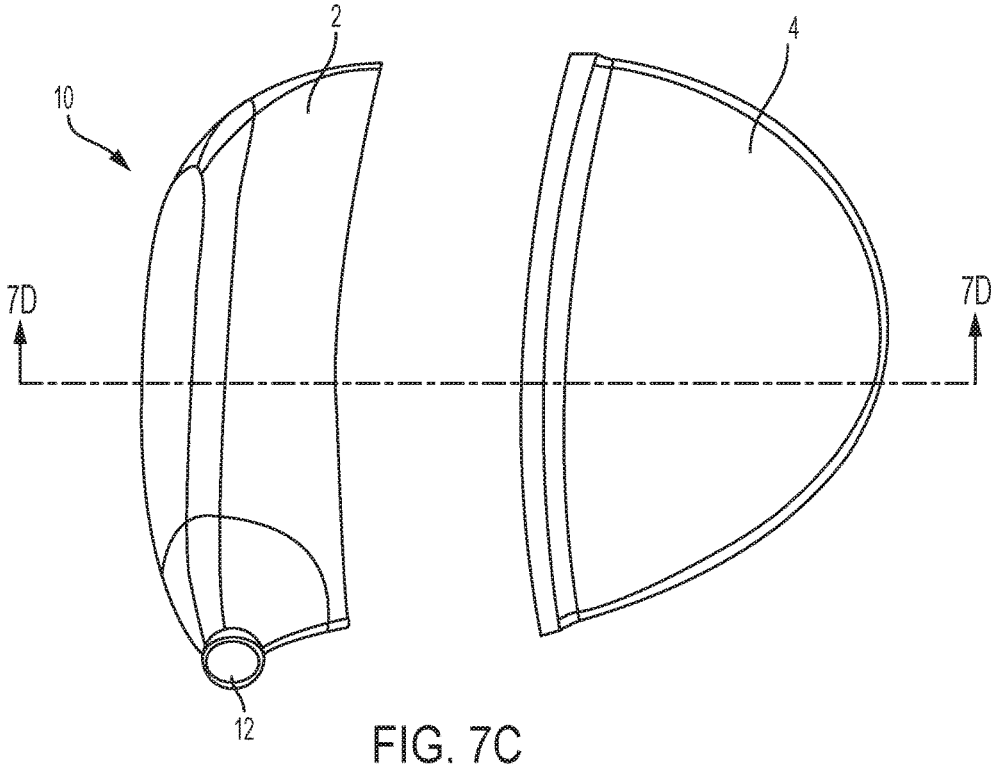
FIG. 7C is an exploded top view of a golf club head in accordance with one embodiment.

Referring to FIGS. 7A and 7B, the front component 2 is manufactured as a single unitary piece. The rear cap component 4 is prepared from the same polymeric material used to prepare the rear cap component 31, in the previous embodiment shown in FIG. 4A. These include the short or long fiber-reinforced formulations of the previously referenced polymers, as well as the previously described composite laminate materials and use the same fabrication methods used to prepare the rear cap component 31. In addition to being formed in the desired shape for the aft body of the club head, the rear cap component 4 may also be formed with additional features including one or more stiffening ribs to impart strength and/or desirable acoustical properties as well as one or more weight ports 18 as shown in FIG. 7D, to allow placement of additional tungsten (or other metal) weights.

The front component 2 includes a striking face portion 6 for striking the ball, and a rearwardly facing sole portion 8, a rearwardly facing crown portion 3 and the walls of the front component 2 further define a hosel opening 12 to allow for insertion of the golf club shaft. In some embodiments the shaft hosel assembly may employ a removable head-shaft connection assembly which may also incorporate features that provide the golf club heads and/or golf clubs with the ability to adjust the loft and/or the lie angle of the club as described in more detail below.

In some embodiments, the striking face portion 6 may also include the same degree of outwardly facing convexity, and this convexity is frequently of a complex-curvature nature. Typically, the striking face portion 6 has both a heel-to-toe convex curvature (referred to as "bulge") and a crown-to-sole convex curvature (referred to as "roll"). In certain embodiments, a variable thickness face profile is implemented as described previously and as shown previously in isolation for the striking plate portion 6500 of FIGS. 6C and 6D.

Figure 7D:
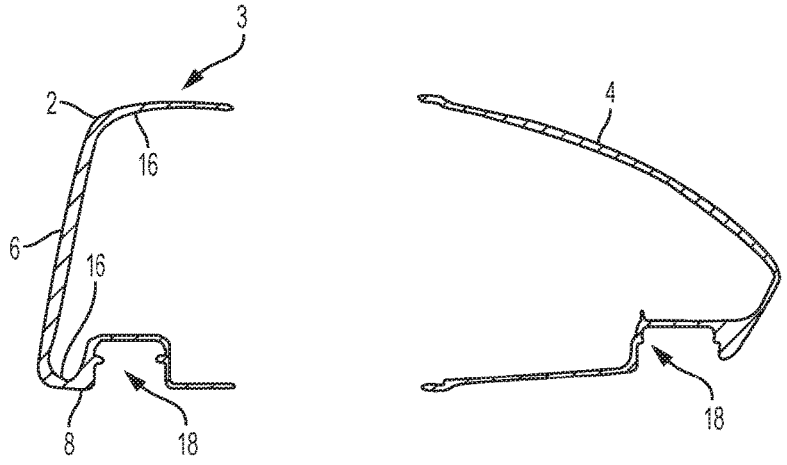
FIG. 7D is a cross sectional view of the line 7D-7D of FIG. 7C.
Figure 7E:
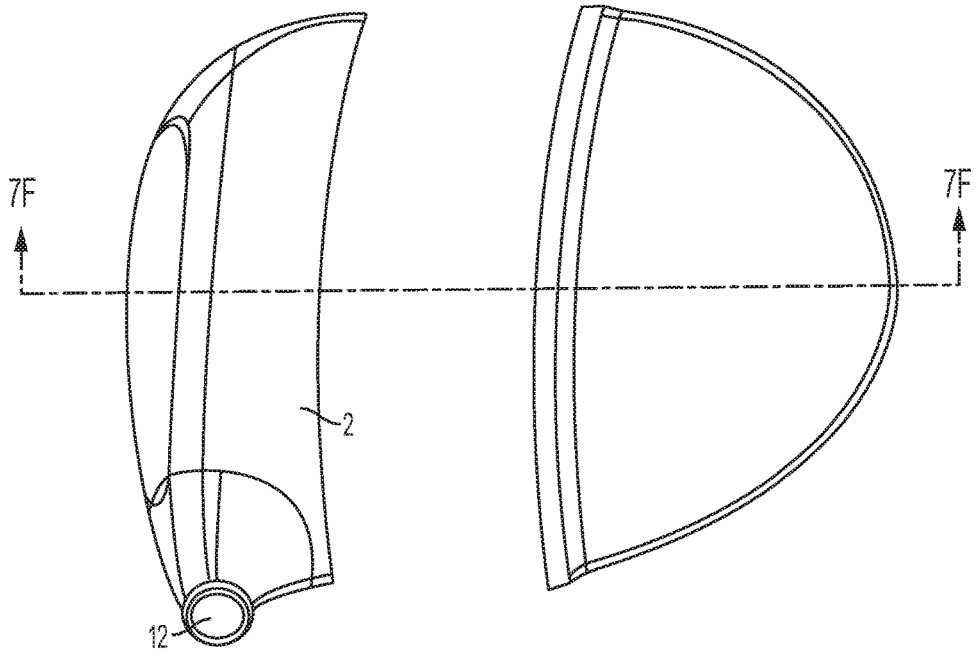
FIG. 7E is an exploded top view of a golf club head in accordance with one embodiment.
Figure 7F:
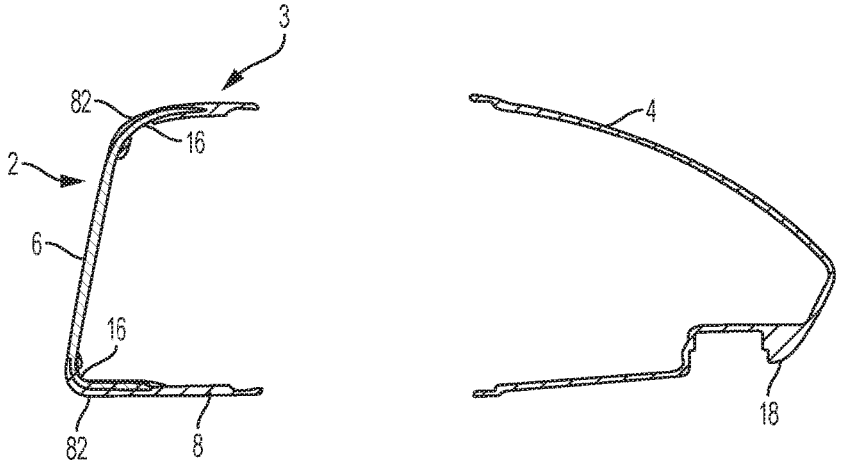
FIG. 7F is a cross sectional view of the line 7F-7F of FIG. 7E.
Figure 7G:
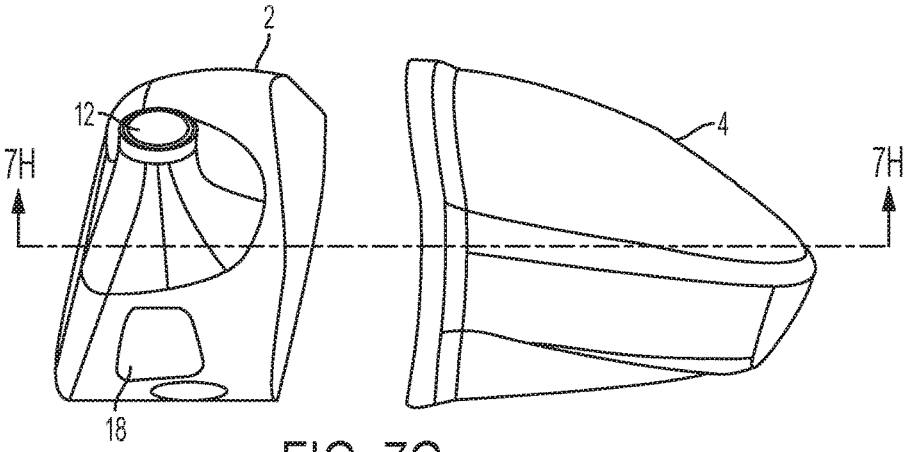
FIG. 7G is an exploded side view of a golf club head in accordance with one embodiment.
Figure 7H:
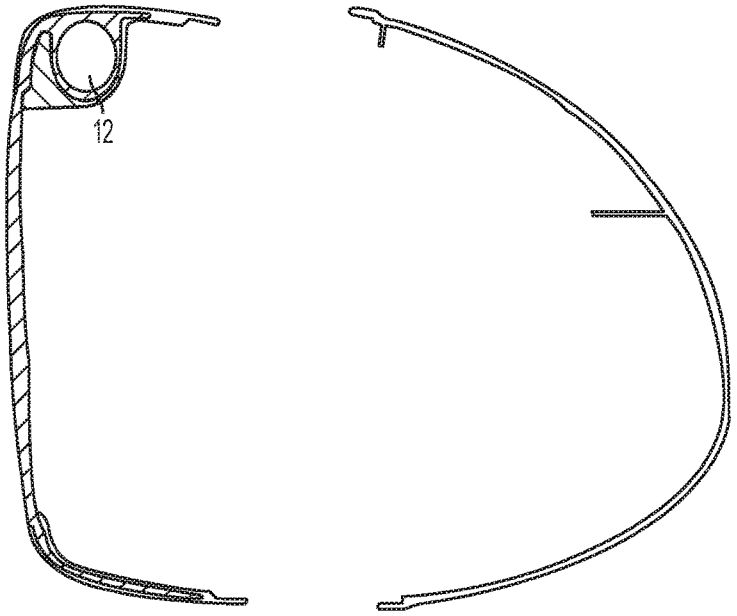
FIG. 7H is a cross sectional view of the line 7H-7H of FIG. 7G.

As shown in the cross sectional view in FIGS. 7D and 7F, the front component 2 also encompasses the transition regions 16 which occur at the critical load bearing sections of the club head. The perimeter of the transition region is defined as the point where the front component transitions from a plane substantially parallel to the striking face portion 6 to a plane substantially perpendicular to the striking face portion 6.

In some embodiments, the front component 2 may include weight ports for the insertion of fixed or movable weights or as shown in FIGS. 7A and 7D a slidably repositionable weight track assembly 18 as described previously to facilitate the ability of the end user of the golf club to adjust the location of the CG of the club head over a range of locations relating to the position of the repositionable weight.

The front component 2 may be prepared from the same strong lightweight material materials as described previously for frame component 30 which can include either metal or a composite material or a polymeric material and any and all combination thereof or subcomponents prepared therefrom. Preferably the front component 2 is made of a metal such as titanium or titanium alloys including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). Other metals which may be used to construct the frame component may include steels or alloys of steel, or any other metal or metal alloy commonly used in golf club head construction including magnesium alloys, copper alloys, and nickel alloys.

The methods of construction can also include those described previously for frame component 30, including investment-casting as a single unit. Alternatively front component 2 may be prepared as a forged structure. In addition to casting or forging, front component 2 may also be prepared by any method for preparing club head components commonly used in the golf industry or new methods for preparing club head components, including (depending on the materials) but not limited to, bladder molding, injection molding, metal-injection-molding, stamping, forming, machining, powdered metal forming, electrochemical milling, thermoforming and any and all combinations thereof.

In the embodiment shown in FIGS. 7E-7H, the front component 2 may also be overmolded by a thermoplastic polymeric outer portion 82 which may or may not cover the striking face and which provides additional reinforcement at the load bearing sections of the club head and allows a more facile connection to the rear cap component 4. The thermoplastic may be one of those described previously to prepare the rear cap component 31. The thickness of the thermoplastic polymeric outer portion 82 may be of from about 0.25 to about 2 mm, preferably of from about 0.5 to about 1.25 mm. The extent of the overmolded polymeric outer portion 82 spans the region from the upper and lower portions of the strike face and further includes the transition regions 16 which occurs at the critical load bearing sections of the club head, and extends beyond the ends of the frame component 2 to form the rearwardly facing upper bonding surface and lower bonding surface, which bonding surfaces serve to connect the front component 2 to the rear cap component 4 as follows.

The rear cap component 4 is securely connected along a front surface thereof to a surface on the front component 2 which extends laterally rearward. This connection may be in the form of a bonded overlay joint, a full lap joint or a half lap joint. As shown in FIGS. 7D and 7E, there is an abutment surface on the rear cap component 4 having an outer surface 35A and an inner surface 35B and a corresponding abutment surface on the rear cap component 4 which has an outer surface and an inner surface.

As described earlier with reference to FIGS. 4C and 4D, this connection may involve an overlay bonding where the inner or interior abutment surface of the rear cap component 4 is overlaid and bonded to the outer or exterior abutment surface of the front component 2, or alternatively an overlay bonding where the inner or interior abutment surface of the front component 2, is overlaid and bonded to the outer or exterior abutment surface of the rear cap component 4. Typically the degree of overlay of the overlay joint is of from about 1 to about 20 mm, preferably of from about 4 to about 8 mm, more preferably of from about 5 to about 7 mm.

As shown previously in FIGS. 5D and 5E, in some embodiments the connection between the rear cap component 4 and the front component 2 can also be between an extension portion on the frame which includes an upper lateral section 42 which extends on both the heel and toe side to a lower lateral section 44, and thereby the extension portion encircles and defines a rear opening 46 of the frame portion.

As shown previously in the expanded view in FIG. 4C showing exploded and joined views, this connection may also involve a half lap joint bonding interaction between the outer or exterior abutment surface 36A of the front component 2 and the inner or interior abutment surface 35B of the rear cap component 4.

Alternatively as shown in the expanded view in FIG. 4D showing exploded and joined views, this connection may also involve a half lap joint bonding interaction between the inner or interior abutment surface 36B of the front component 2 and the outer or exterior abutment surface 35A of the rear cap component 4.

Typically the degree of overlap of the lap joint (corresponding to the distance d1 in FIGS. 4B-4D) is of from about 1 to about 20 mm, preferably of from about 4 to about 8 mm, more preferably of from about 5 to about 7 mm.

Figure 8A:
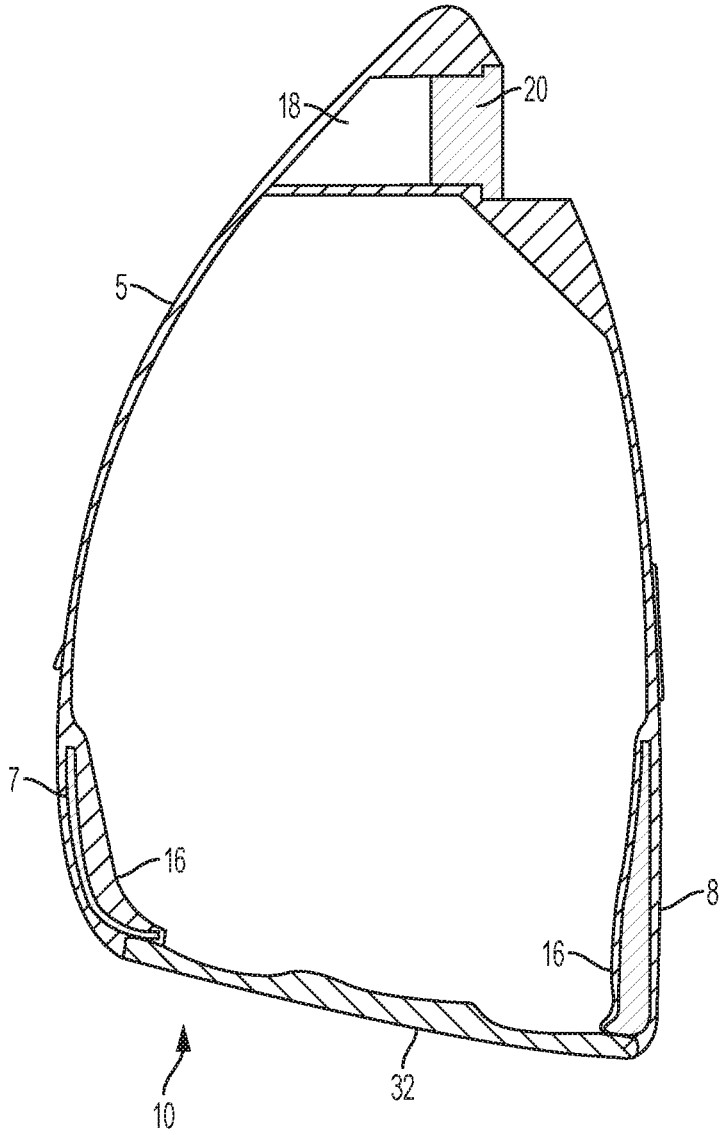
FIG. 8A is a cross sectional side view of the front of a golf club head in accordance with one embodiment.
Figure 8B:
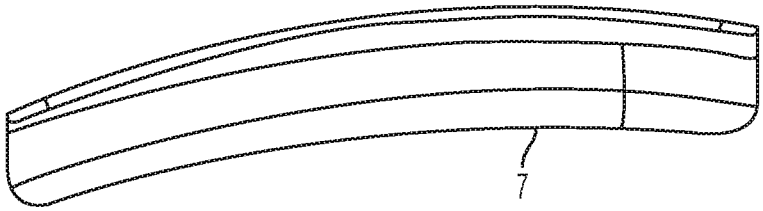
FIG. 8B is an exploded view of a crown reinforcing insert of a shell component of a golf club head in accordance with one embodiment.
Figure 8C:
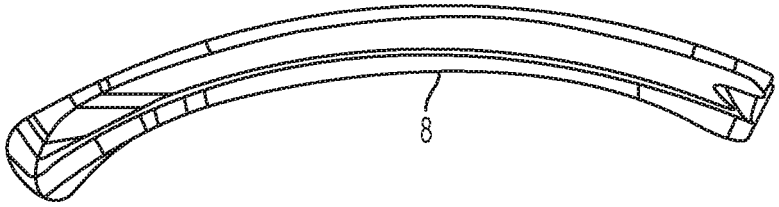
FIG. 8C is an exploded view of a sole or skirt reinforcing insert of a shell component of a golf club head in accordance with one embodiment.

In another embodiment shown in FIGS. 8A-8C, the club head 10 may also comprise a unitary body having a shell 5 which is prepared using the same materials and having the same properties as previously described, including the short or long fiber-reinforced formulations of the previously referenced polymers, as well as the previously described composite laminate materials, and using the same fabrication methods used to prepare the rear cap component 31 and rear cap component 4. In addition to being formed in the desired shape for the aft body of the club head, the shell 5 may also be formed with a hosel, front opening and strike plate which is fitted to the front opening of the frame portion, as described previously in connection with the front opening 48 and strike plate 32. The strike plate 32 can be welded or bonded to the to the shell 5 using adhesive or by other suitable method. The strike plate 32 normally has some degree of outwardly facing convexity, and this convexity is frequently of a complex-curvature nature. Typically, the striking face 32 has both a heel-to-toe convex curvature (referred to as "bulge") and a crown-to-sole convex curvature (referred to as "roll"). In certain embodiments, a variable thickness face profile is implemented according to U.S. patent application Ser. No. 12/006,060, U.S. Pat. Nos. 6,997,820, 6,800,038, and 6,824,475, which are incorporated herein by reference in their entirety. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for reallocation to another area of the club head.

The shell 5 may also contain additional features including one or more stiffening ribs to impart strength and/or desirable acoustical properties as well as one or more weight ports 18 and weights 20 as shown in FIG. 8A, to allow placement of additional tungsten (or other metal) weights.

The shell 5 includes the transition region 16 which occurs at the critical load bearing sections of the club head. The shell 5 can be selectively strengthened by overmolding it over one or more upper or crown reinforcing inserts 7 as shown in more detail in FIG. 8B, and one or more sole or skirt reinforcing inserts 8 as shown in more detail in FIG. 8C, such that their length includes the critical load bearing points or sections in the club head. The reinforcing inserts may comprise metals such as steel or titanium, or fibers (such as carbon fiber, glass fiber or polymeric fibers such as polyaramid) or composite materials.

Alternatively or in addition to the selectively strengthening of the shell 5 by overmolding over one or more upper or crown reinforcing inserts 7 and one or more sole or skirt reinforcing inserts 8, the polymeric body may be strengthened on its inner and outer surfaces along areas which include the critical load bearing points, by the application of metallic coatings or layers to the surfaces of polymer parts. Metallic materials, layers and/or coatings are strong, hard, tough and aesthetic and can be applied to polymer substrates by various low temperature commercial process methods including electrode less deposition techniques and/or electro deposition. The metal deposits must adhere well to the underlying polymer substrate even in corrosive environments and when subjected to thermal cycling and loads, as encountered in outdoor or industrial service. In an especially preferred embodiment the polymeric body is coated with a coating/layer of the reinforcing metal on both sides. The metallic coating/layer is selected from the group of amorphous, fine-grained and coarse-grained metal, metal alloy or metal matrix composites.

The metallic coating/layer is applied to the polymer substrate by a suitable metal deposition process. Preferred metal deposition processes include low temperature processes, i.e., processes operating below the softening and/or melting temperature of the polymer substrates, selected from the group of electrode less deposition, electro deposition, physical vapor deposition (PVD), chemical vapor deposition (CVD) and gas condensation. Alternatively, the polymer can be applied to a metallic layer. The metallic material represents between 5 and 95% of the total weight of the article. The metallic layer may be in the form of single or multiple structural metallic layers having a microstructure selected from the group of fine-grained, amorphous, graded and layered structures, which have a total thickness in the range of between 10 micron and 5 cm, preferably between 25 micron and 2.5 cm and more preferably between 50 micron and 500 micron. The metallic layer comprises one or more elements selected from the group of Ag, Al, Au, Co, Cr, Cu, Fe, Ni, Mo, Pb, Pd, Pt, Rh, Ru, Sn, Ti, W, Zn and Zr. Metal matrix composites consist of fine-grained and/or amorphous pure metals or alloys with suitable particulate additives. The latter additives include powders, fibers, nanotubes, flakes, metal powders, metal alloy powders and metal oxide powders of Al, Co, Cu, In, Mg, Ni, Si, Sn, V, and Zn; nitrides of Al, B and Si; C (graphite, diamond, nanotubes, Buckminster Fullerenes); carbides of B, Cr, Bi, Si, W; and self-lubricating materials such as $MoS_2$ or organic materials e.g. PTFE. The fine-grained and/or amorphous metallic material has a high yield strength (300 MPa to 2,750 MPa) and ductility (1-15%).

Figure 9A:
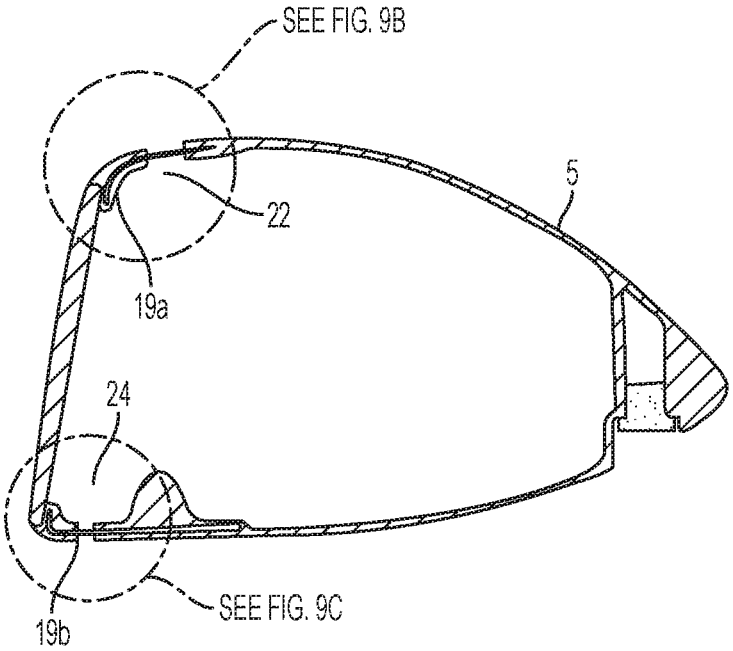
FIG. 9A is a cross sectional side view of a golf club head in accordance with one embodiment.
Figure 9B:
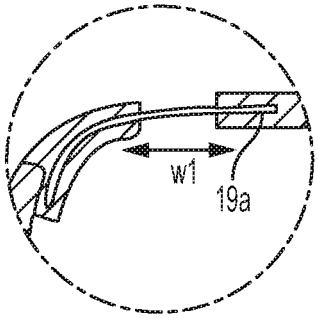
FIG. 9B is an enlarged view of a portion of FIG. 9A.
Figure 9C:
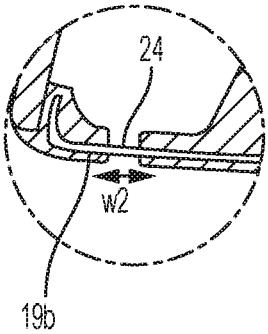
FIG. 9C is an enlarged view of another portion of FIG. 9A.

In an especially preferred embodiment, as shown in more detail in FIG. 9A, the rear shell 5 has a gap or discontinuity in the shell where it has been overmolded over one or more upper or crown reinforcing inserts 19*a* to form a crown channel 22 and/or a gap or discontinuity in the shell where it has been overmolded over one or more lower or sole or skirt reinforcing inserts 19*b* to form a sole or skirt channel 24. Exposing a portion of the one or more upper or crown reinforcing inserts 19*a*, or one or more lower or sole or skirt reinforcing inserts 19*b*, serves to further dissipate the stresses which occur on impact at the critical load bearing sections of the club head. As shown in more detail in FIGS. 9B and 9C, the crown channel 22 has a width W1 and the sole or skirt channel 24 has a width W2. The width W1 of the crown channel 22 may vary of from about 2 to about 14 mm, preferably of from about 4 to about 12 mm, and even more preferably from about 6 to about 10 mm. The width W2 of the sole or skirt channel 24 may vary of from about 0.5 to about 10 mm, preferably of from about 2 to about 8 mm, and even more preferably of from about 3 to about 6 mm.

Figure 9D:
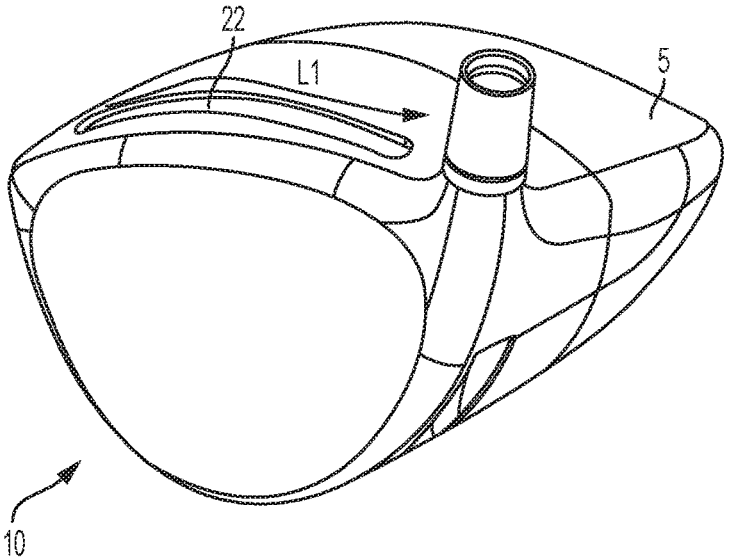
FIG. 9D is a front perspective view of a golf club head in accordance with one embodiment.
Figure 9E:
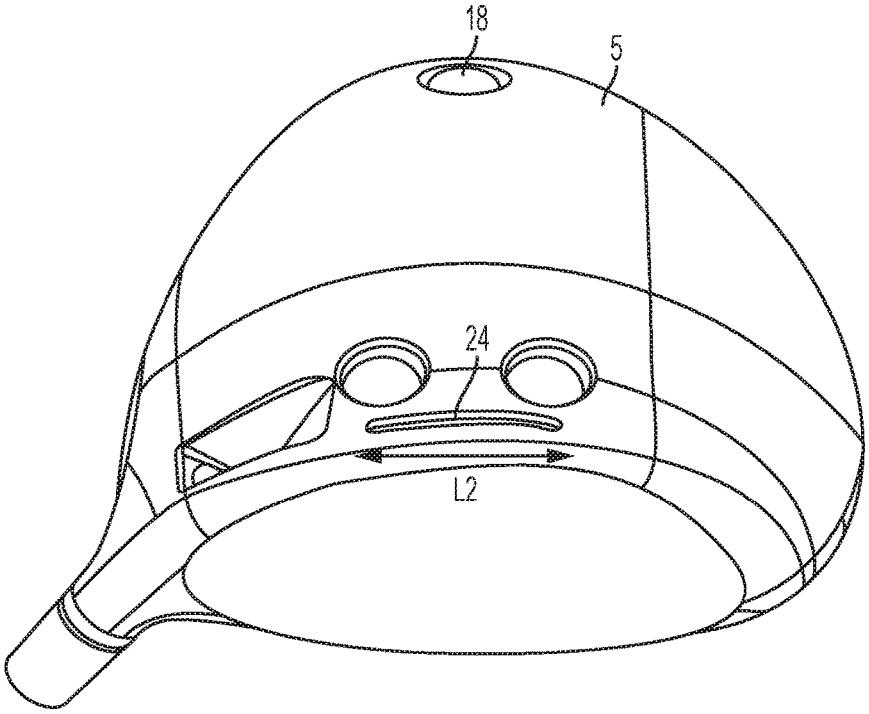
FIG. 9E is a bottom view of a golf club head in accordance with one embodiment.

As shown in FIGS. 9D and 9E, the crown channel 22 and sole or skirt channel 24 may span a distance of the club which may be less than or substantially similar in length to that of the length of the respective upper portion and lower portion of the striking face. As shown in more detail in FIG. 9D, in some embodiments the length L1 of the crown channel may vary from about 20 to about 120 mm, preferably from about 40 to about 100 mm, and even more preferably from about 60 to about 90 mm.

As shown in more detail in FIG. 9E, the length L2 of the sole or skirt channel 24 may vary from about 20 to about 120 mm, preferably from about 40 to about 100 mm, and even more preferably from about 60 to about 90 mm.

Figure 9G:
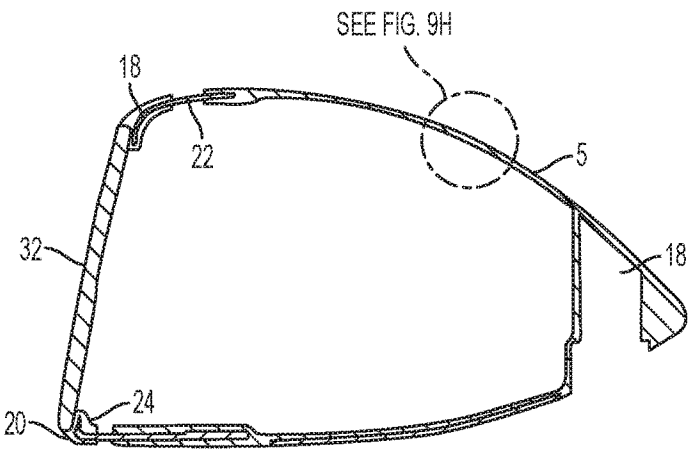
FIG. 9G is a cross sectional view of the line 9G-9G of FIG. 9F.
Figure 9H:
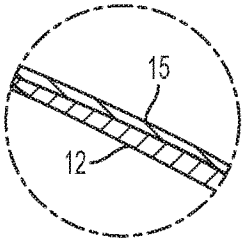
FIG. 9H is an enlarged view of a portion of FIG. 9G.
Figure 9F:
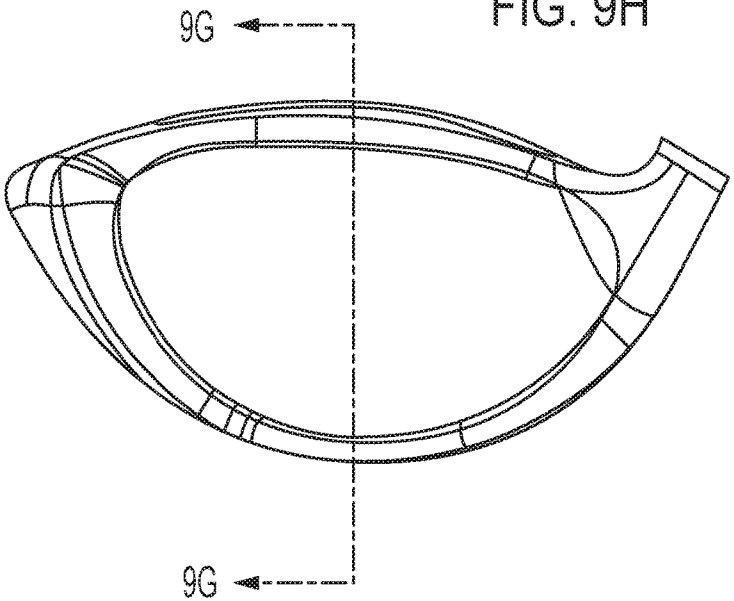
FIG. 9F is a front view of a golf club head in accordance with one embodiment.

In a specially preferred embodiment shown in FIGS. 9F-9H, the rear shell 5 like the previously described rear cap component 31, is formed as a two layered structure comprising an injection molded inner layer 12 and an outer layer 15 comprising a thermoplastic composite laminate. The injection molded inner layer may be prepared from the thermoplastic polymers as described previously for use in forming the rear cap component 31, with preferred materials including a polyamide (PA), or thermoplastic urethane (TPU) or a polyphenylene sulfide (PPS). Typically the thermoplastic composite laminate structures used to prepare the outer layer 15 are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

In one preferred method of preparation, an insert molding, injection molding or overmolding process may be used in which the preformed composite laminate outer layer is insert molded to the injection molded inner layer to provide additional strength. During this process, the thermoplastic material of the inner layer 12 is molded to the inner surface of the composite laminate structure and the materials fuse together to form the rear shell 5*a* as a highly integrated part. Typically the injection molded inner layer 12 is prepared from the same polymer family as the matrix material used in the formation of the composite laminate structures used to form the outer layer 15, so as to ensure a good weld bond. In an alternative hybrid molding process the composite laminate outer layer is introduced into an injection mold as a heated flat sheet and formed simultaneously as the injection molded inner layer is formed around the outer layer.

In addition to being formed in the desired shape for the aft body of the club head, the thermoplastic inner layer 12 may also be formed with additional features including one or more stiffening ribs to impart strength and/or desirable acoustical properties as well as one or more weight ports 18 to allow placement of additional tungsten (or other metal) weights.

The thickness of the inner layer is typically of from about 0.25 to about 2 mm, preferably of from about 0.5 to about 1.25 mm.

The thickness of the composite laminate structure used to form the outer layer 15, is typically of from about 0.25 to about 2 mm, preferably of from about 0.5 to about 1.25 mm.

Figure 10A:
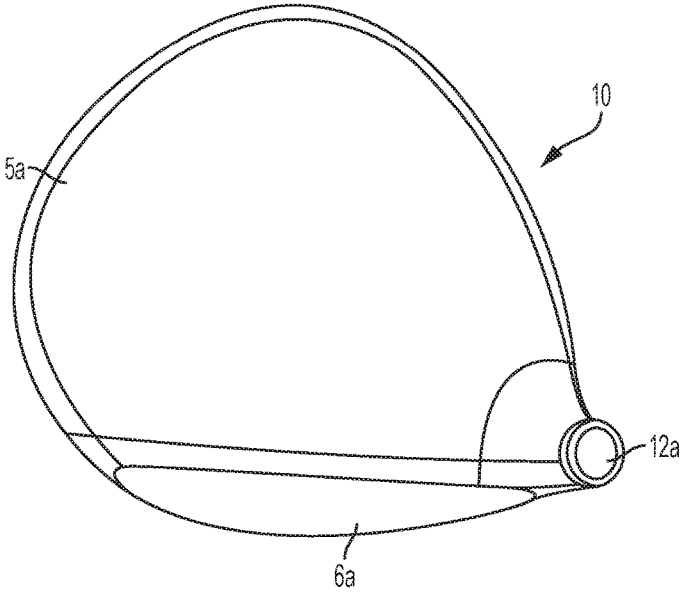
FIG. 10A is a top view of a golf club head in accordance with one embodiment.
Figure 10B:
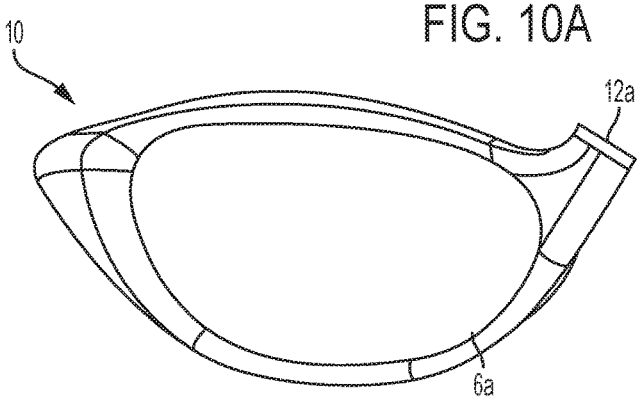
FIG. 10B is a front view of a golf club head in accordance with one embodiment.
Figure 10C:
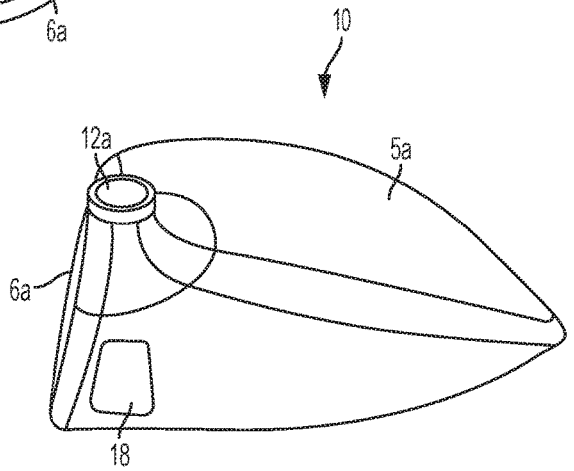
FIG. 10C is a side view of a golf club head in accordance with one embodiment.

In an especially preferred embodiment as shown in FIGS. 10A-10C, the club head 10 may also comprise a unitary body having a shell 5*a* which is prepared using the same materials and having the same properties as previously described, including the short or long fiber-reinforced formulations of the previously referenced polymers, as well as the previously described composite laminate materials, and using the same fabrication methods used to prepare the rear cap component 31. The walls of the shell 5*a* further define a hosel opening 12*a* to allow for insertion of the golf club shaft. In some embodiments the shaft hosel assembly may employ a removable head-shaft connection assembly which may also incorporate features that provide the golf club heads and/or golf clubs with the ability to adjust the loft and/or the lie angle of the club as described in more detail below.

Figure 10D:
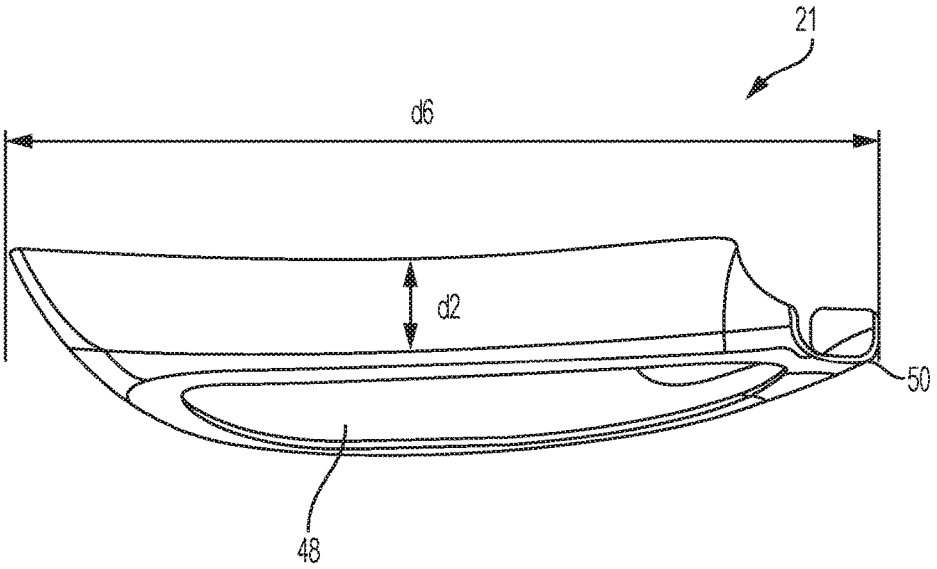
FIG. 10D is a top view of a frame insert of a shell of a golf club head in accordance with one embodiment.
Figure 10E:
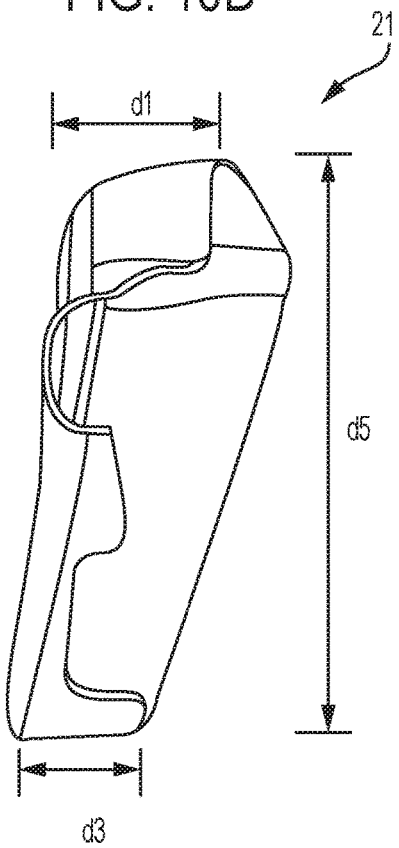
FIG. 10E is a side view of a frame insert of a shell of a golf club head in accordance with one embodiment.
Figure 10F:
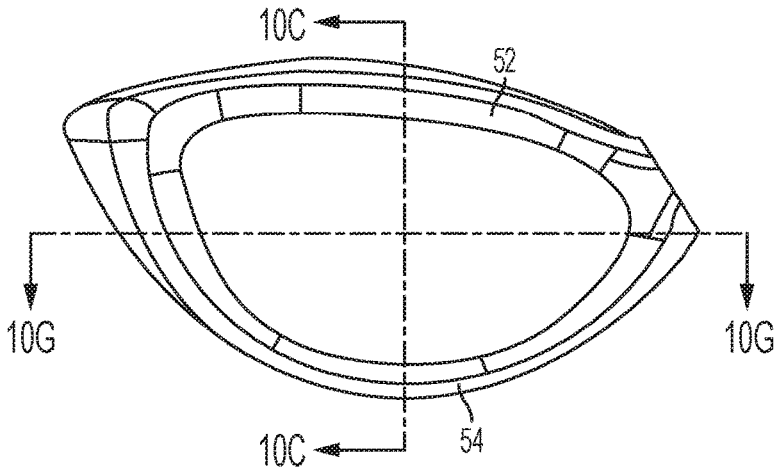
FIG. 10F is a front view of a frame insert of a shell of a golf club head in accordance with one embodiment.
Figure 10G:
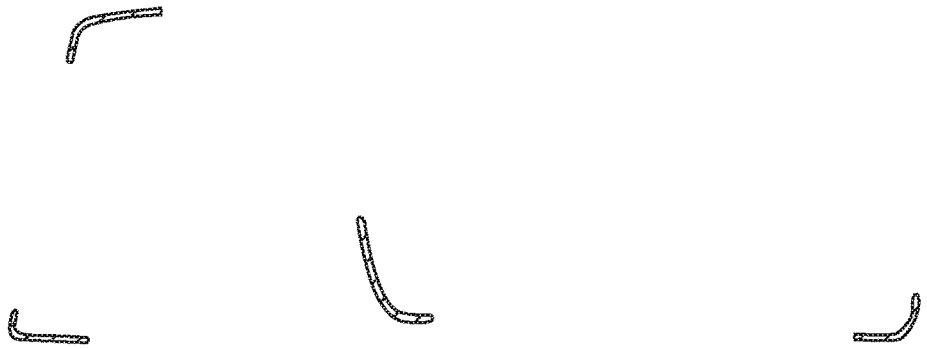
FIG. 10G shows cross sectional views along lines 10C-10C and 10G-10G of FIG. 10F.

In order to i) selectively strengthen the club head at the load bearing portions where higher strength is required and ii) also provide a bonding surface for the subsequently attached striking face insert 6*a* and iii) facilitate the ease of production of the final club head 10, the shell 5*a* can be overmolded over a one piece frame insert 21 shown in FIGS. 10D and 10E. The walls of the frame insert 21 define a forwardly facing front opening 48 with a forward facing aspect which conforms to the front of the club head. The frame insert 21 also has a portion 50 which corresponds to the hosel attachment portion of the club head and functions to further reinforce the hosel on the shell 5*a* by wrappings around the hosel by no more than 180 degrees. Referring to FIGS. 10D-10G, the upper or crown portion of the frame insert 21 has a depth d1, a depth at the sole d2, a maximum height d5 and a maximum width d6.

Referring to FIG. 10E, the upper or crown portion of the frame insert 21 has a depth d1 of about 1 to about 32 mm, preferably of about 8 to about 28 mm, more preferably of about 12 to about 24 mm, and the lower or sole portion of the frame insert 21 has a depth d3 is of about 1 to about 32 mm, preferably of about 8 to about 28 mm, more preferably of about 12 to about 24 mm.

Referring to FIG. 10E, the frame insert 21 also has a maximum height d5 of about 40 to about 90 mm, preferably of about 50 to about 80 mm, more preferably of about 60 to about 70 mm.

Referring to FIG. 10D, the frame insert 21 also has a maximum width d6 of about 80 to about 130 mm, preferably of about 90 to about 127 mm, more preferably of about 110 to about 127 mm.

Figure 10H:
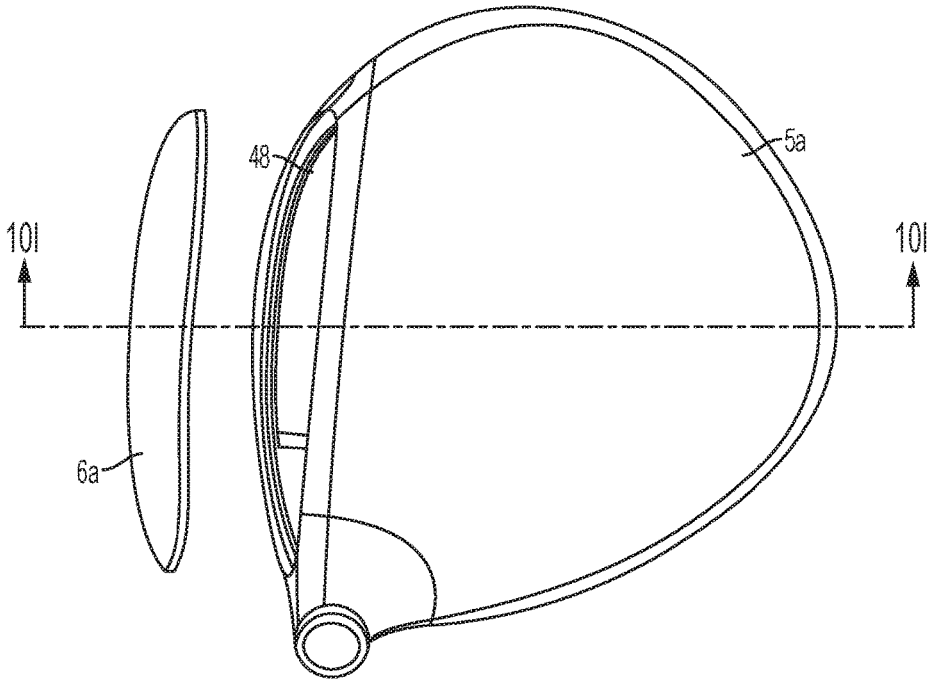
FIG. 10H is a top view of a golf club head in accordance with one embodiment.
Figure 10I:
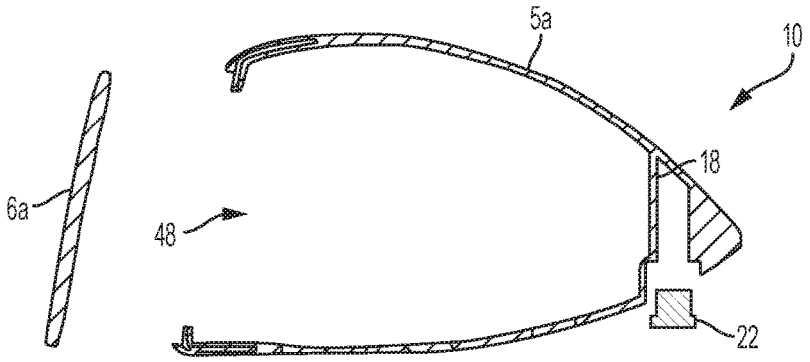
FIG. 10I is a cross sectional side view of line 10I-10I of FIG. 10H.

As shown in FIG. 10H and the sectional view 10I, the frame insert 21 also has a lip or transition zone around the front opening 48 which is recessed, allowing the striking plate 6*a* (strike surface) to be bonded to and be flush with the forward wall of the body. The transition zone" extends along the respective forward edges of the frame insert heel, frame insert toe, frame insert sole and frame insert crown. The transition zone effectively is a transition from the front facing walls of the frame insert 21 to the face plate or strike plate 6*a*. The opening 48 receives the strike plate 6*a*, which rests upon and is bonded to the transition zone, thereby enclosing the front opening 48. The transition zone includes a crown-lip region, sole-lip region, heel-lip region, and toe-lip region. The crown-lip region has a width d2 (FIG. 10D) of about 1 to about 12 mm, preferably of about 3 to about 8 mm, more preferably of about 4 to about 6 mm and the sole-lip region has a width d3 of about 1 to about 12 mm, preferably of about 3 to about 8 mm, more preferably of about 4 to about 6 mm.

In order to provide a suitable surface for attachment in some embodiments, the lip portion of the face inset 21 is not bonded to the shell but rather remains exposed to allow attachment of the strike plate 6.

The frame insert 21 is made from a strong lightweight material which can include either metal or a composite material or a polymeric material and any and all combination thereof or subcomponents prepared therefrom. In some embodiments, the frame insert 21 may be prepared from the same polymeric material used to prepare the rear cap component 31 as described previously, including the short or long fiber-reinforced formulations of the previously referenced polymers, as well as the previously described composite laminate materials Preferably the frame insert 21 is made of a metal such as titanium or titanium alloys including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075).

Other metals which may be used to construct the frame component may include steels or alloys of steel, or any other metal or metal alloy commonly used in golf club head construction including magnesium alloys, copper alloys, and nickel alloys. The frame component may comprise a forged aluminum component such aluminum alloy 7075, which is an aluminum alloy with zinc as the primary alloying element. It is strong, with strength comparable to many steels, and has good fatigue strength and average machinability, but has less resistance to corrosion than many other Al alloys. Its relatively high cost limits its use to applications where cheaper alloys are not suitable. The 7075 aluminum alloy's composition includes (in addition to aluminum) 5.6-6.1 wt % zinc, 2.1-2.5 wt % magnesium, 1.2-1.6 wt % copper, and less than half a percent by weight of silicon, iron, manganese, titanium, chromium, and other metals. It is produced in many tempers, one preferred temper is T6. T6 temper 7075 has an ultimate tensile strength of 74,000-78,000 psi (510-572 MPa) and yield strength of at least 63,000-69,000 psi (434-503 MPa). It has a failure elongation of 5-11%. The T6 temper is usually achieved by homogenizing the cast 7075 at 450° C. for several hours, and then ageing at 120° C. for 24 hours. This yields the peak strength of the 7075 alloy. The strength is derived mainly from finely dispersed eta and eta' precipitates both within grains and along grain boundaries.

The frame insert 21 may be prepared by investment-casting as a single unit using a casting shell that defines details both in the cavity and on the outside of the body. Alternatively the frame insert 21 may be prepared as a forged structure. Most preferably, the frame insert 21 is made via a stamping or pressing process from a sheet of the desired metal of construction. In addition to casting or forging or stamping, the frame insert 21 may be prepared by any method for preparing club head components commonly used in the golf industry or new methods for preparing club head components, including (depending on the materials) but not limited to, bladder molding, injection molding, metal-injection-molding, forming, machining, powdered metal forming, electrochemical milling, thermoforming and any and all combinations thereof.

Figure 10J:
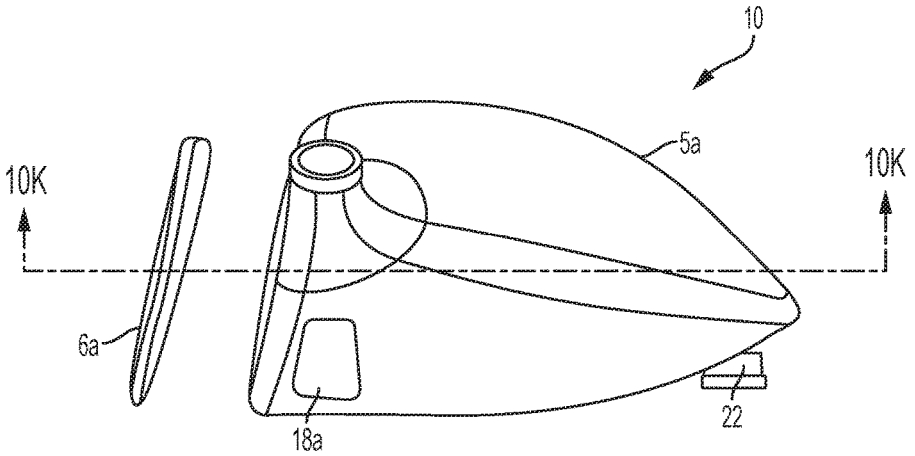
FIG. 10J is a side view of a golf club head in accordance with one embodiment.
Figure 10K:
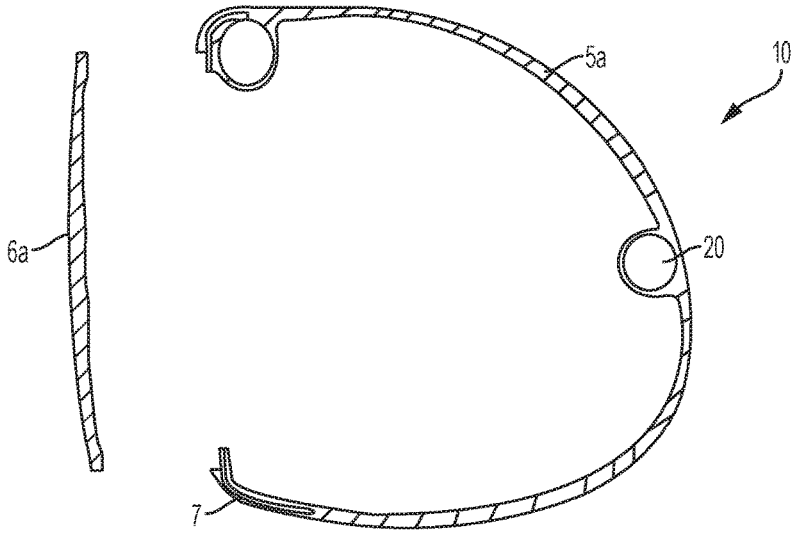
FIG. 10K is a cross sectional view of the line 10K-10K of FIG. 10J.
Figure 10L:
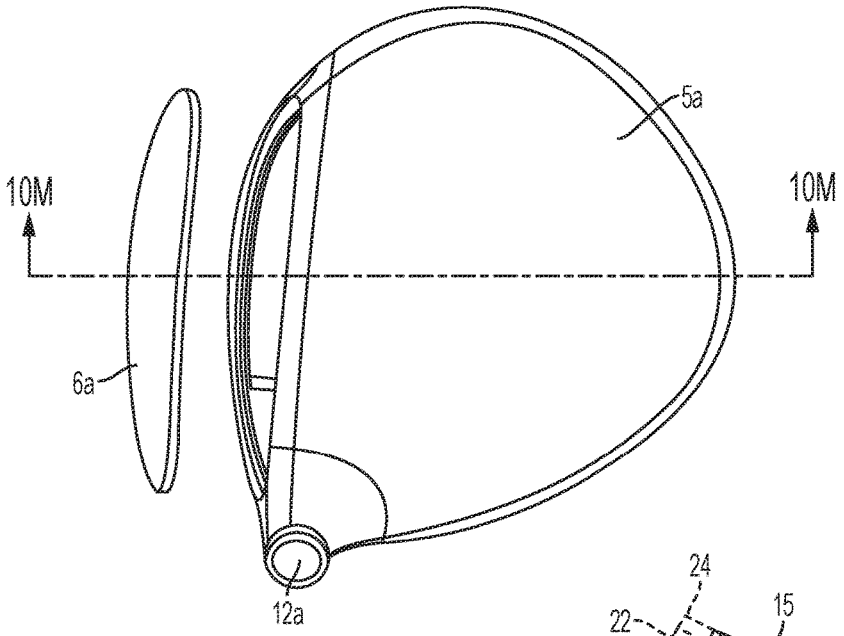
FIG. 10L is a cross sectional side view of a golf club head in accordance with one embodiment.
Figure 10N:
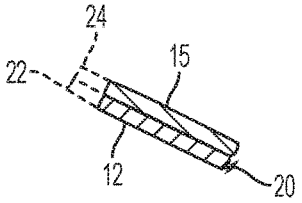
FIG. 10N is an enlarged view of a portion of FIG. 10M.

The shell 5*a* is prepared using the same materials and having the same properties as previously described including the short or long fiber-reinforced formulations of the previously referenced polymers, used to prepare the rear cap component 31. In addition to being formed in the desired shape for the aft body of the club head, the shell 5*a* may also be formed with additional features including one or more stiffening ribs to impart strength and/or desirable acoustical properties as well as one or more weight ports 18, to allow placement of additional tungsten (or other metal) weights 22 as shown in FIGS. 101-10K. As shown in FIG. 10J, in some embodiments, the shell 5*a* may include a slidably repositionable weight track assembly 18*a* as described previously to facilitate the ability of the end user of the golf club to adjust the location of the CG of the club head over a range of locations relating to the position of the repositionable weight.

In an especially preferred embodiment, as shown in FIGS. 10L-10P, the shell 5*a* is formed as a two layered structure comprising an injection molded inner layer 12 and an outer layer 15 comprising a thermoplastic composite laminate. The injection molded inner layer may be prepared from the thermoplastic polymers as described previously for use in forming the rear cap component, with preferred materials including a polyamide (PA), or thermoplastic urethane (TPU) or a polyphenylene sulfide (PPS).

Typically the thermoplastic composite laminate structures used to prepare the outer layer 15 are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS). The laminates may be formed in a process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered shell 5*a* shown in the differing perspectives in FIGS. 10L-10P may be formed. In some embodiments the outer layer 15, is formed separately and discretely from the forming of the injection molded inner layer 12. The outer layer 15 may be formed using known techniques for shaping thermoplastic composite laminates into parts including but not limited to compression molding or rubber and matched metal press forming or diaphragm forming.

The inner layer 12 may be injection molded using conventional techniques and secured to the outer crown layer 15, by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer 12 is secured to the outer layer 15, the outer surface of the inner layer 12 and/or the inner of the outer layer 15 may be pretreated by means of one or more of the following processes (disclosed in more detail in Ehrenstein, "Handbuch Kunststoff-Verbindungstechnik", Carl Hanser Verlag Munich 2004, pages 494-504):

- Mechanical treatment, preferably by brushing or grinding,
- Cleaning with liquids, preferably with aqueous solutions or organics solvents for removal of surface deposits
- Flame treatment, preferably with propane gas, natural gas, town gas or butane
- Corona treatment (potential-loaded atmospheric pressure plasma)
- Potential-free atmospheric pressure plasma treatment
- Low pressure plasma treatment (air and 02 atmosphere)
- UV light treatment
- Chemical pretreatment, e.g. by wet chemistry by gas phase pretreatment
- Primers and coupling agents In one preferred method of preparation, an insert molding, injection molding or overmolding process may be used in which the composite laminate outer layer is insert molded to the injection molded inner layer to provide additional strength. During this process, the thermoplastic material of the inner layer 12 is molded to the inner surface of the composite laminate structure and the materials fuse together to form the multilayered shell 5*a* as a highly integrated part. Typically the injection molded inner layer 12 is prepared from the same polymer family as the matrix material used in the formation of the composite laminate structures used to form the outer layer 15, so as to ensure a good weld bond. In an alternative hybrid molding process the composite laminate outer layer is introduced into an injection mold as a heated flat sheet and formed simultaneously with the inner layer as thermoplastic material is introduced into the mold around the outer layer.

The thickness 20 of the inner layer is typically about 0.25 to about 2 mm, preferably about 0.5 to about 1.25 mm, although as shown in FIG. 4C it may be considerably thicker at areas which also form a weight port 18.

The thickness of the composite laminate structure used to form the outer layer 15, is typically about 0.25 to about 2 mm, preferably about 0.5 to about 1.25 mm.

Figure 10M:
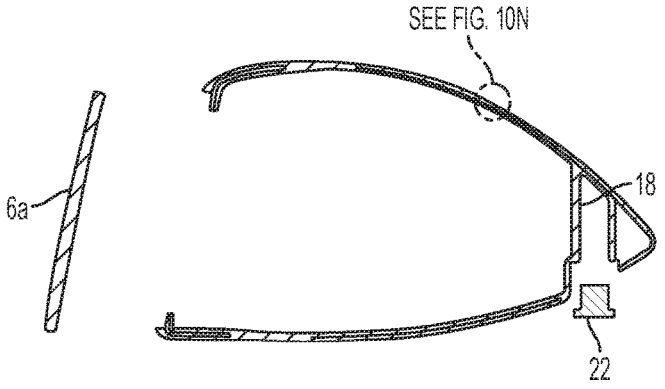
FIG. 10M is a cross sectional view of the line 10M-10M of FIG. 10L.
Figure 10O:
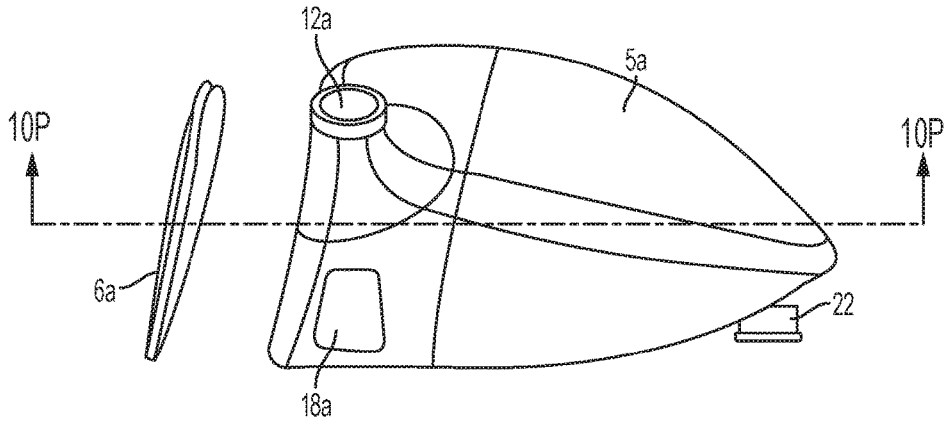
FIG. 10O is a side view of a golf club head in accordance with one embodiment.
Figure 10P:
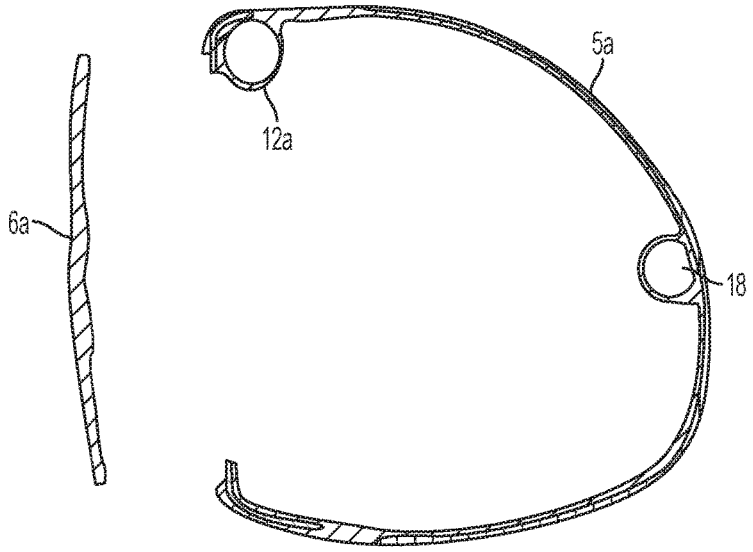
FIG. 10P is a cross sectional view of the line 10P-10P of FIG. 10O.

In addition to being formed in the desired shape for the aft body of the club head, the thermoplastic inner layer 12 may also be formed with additional features including one or more stiffening ribs to impart strength and/or desirable acoustical properties as well as one or more weight ports 18 and weights 22 as shown in FIGS. 10M, 100 and 10P to allow placement of additional tungsten (or other metal) weights. As shown in FIG. 10O the shell 5*a* may also incorporate a slidably repositionable weight track assembly 18*a* as described previously to facilitate the ability of the end user of the golf club to adjust the location of the CG of the club head over a range of locations relating to the position of the repositionable weight.

The frame and the shell component when connected collectively define an outer envelope and enclose an internal volume of the club head.

Thus utilizing the materials methods and construction as described above the clubclub head 10 (absent the placement of additional weighting) has a weight of less than about 195 g, preferably less than about 170 g, more preferably less than about 148 g. Typically golfers prefer a driver type golf club head to have a weight of less than 250 g, as above this weight one can observe a negative impact on a golfers swing speed and hence ball distance. Thus even targeting a final weight of 250 g, utilizing the materials methods and construction as described previously results in the potential for the addition of almost about 20 to about 100 g of so called discretionary weight in placements at various points on the club head. The ability to incorporate additional weighting is a result of utilizing the materials methods and construction as described above make available additional discretionary weight placement while maintaining the overall club head weight in the normal ranges for generating the required club head speed.

It should be appreciated that various weights and weight positions may be selected on the club head in order to maximize club head performance for a given golfer. Such positions include internal weight placement at various positions within the club head, in addition to external and optionally user repositionable weight placements on the outer surface of the club head including both user repositionable weights located in one or more weight ports located on the outside of the club head, as well as one or more slidably repositionable weights located within a channel on the outside of the club head both of which will be described in more detail hereinafter. This then allows further tuning and optimization of club head properties such as Moment of Inertia and Center of Gravity (CG) placement to give the desired club performance.

Thus utilizing the materials methods and construction and as described previously, the club head in certain embodiments is able to achieve a moment of inertia about the heel toe axis, Ixx, of greater than about 200, preferably greater than about 220, more preferably greater than about 250 and even more preferably greater than about 270 $kg{\cdot}mm^2$.

Similarly, in certain embodiments the club head is able to achieve a moment of inertia about the Izz axis of greater than about 320 $kg{\cdot}mm^2$, greater than about 360 $Kg{\cdot}mm^2$, or greater than about 440 $Kg{\cdot}mm^2$. The club head also may achieve a COR greater than about 0.790, greater than about 0.800 or greater than about 0.810.

The club head also has a Center of Gravity position which lies below the horizontal centerline or center face of the club head by about 1 mm, by about 2 mm, about 3 mm, or about 4 mm. In another embodiment, the CG may lie below a horizontal plane located about 2 mm above the center face, about 1 mm above the center face, or may lie generally in the same horizontal plane of the center face.

The club head also has a Center of Gravity position (CG) which is located a distance back from the strike face a distance from the hosel axis (delta 1) which is in the range of 1-30 mm. For embodiments in which a forward CG position is desired the delta 1 values range of from about 2 to about 16 mm, preferably from about 4 to about 12 mm and more preferably from about 4 to about 9 mm. For embodiments in which a back CG position is desired the delta 1 values range from about 8 to about 30 mm, preferably from about 16 to about 30 mm and more preferably from about 20 to about 30 mm.

In addition to the strength properties of the golf club head of the present invention, in certain embodiments, the shape and dimensions of the golf club head may be formed so as to produce an aerodynamic shape as according to U.S. Patent Publication No. 20130123040 A1, filed on Dec. 18, 2012 to Willett et al., the entire contents of which are incorporated by reference herein in their entirety.

In addition to the strength properties of the aft body, and the aerodynamic properties of the club head, another set of properties of the club head which must be controlled are the acoustical properties or the sound that a golf club head emits when it strikes a golf ball. At club head/golf ball impact, a club striking face is deformed so that vibrational modes of the club head associated with the club crown, sole, or striking face are excited. The geometry of most golf clubs is complex, consisting of surfaces having a variety of curvatures, thicknesses, and materials, and precise calculation of club head modes may be difficult. Club head modes can be calculated using computer-aided simulation tools. For the club heads of the present invention the acoustic signal produced with ball/club impact can be evaluated as described in copending U.S. application Ser. No. 13/842,011 filed on Mar. 15, 2013 in the name of Taylor Made Golf Co. Inc., the entire contents of which are incorporated by reference herein in their entirety.

Generally, club face acoustic modes at frequencies less than about 3 kHz, 3.5 kHz, or 3.8 kHz are associated with unpleasant sounds when used to strike a golf ball. Acoustic modes at these frequencies in the sole or crown can also cause a club to have an unpleasant sound. Conventional titanium or steel faces tend to exhibit such resonance frequencies due to the combination of material density, striking plate thickness, and elastic constant for the large club faces preferred by many golfers. However, with the golf club heads having a rear cap component comprising a plastic material and/or a composite striking plate, material properties are substantially changed so that face acoustic resonance frequencies can be raised to frequencies of 3.9 kHz, 4.0 kHz, 4.5 kHz or higher, thereby providing golf clubs that have satisfactory sound characteristics. Because sound quality is particularly significant for driver type clubs, such clubs are discussed herein but other clubs such as fairway woods can be similarly configured even though these clubs have much less tendency to produce unpleasant sounds.

A method of evaluating the club head sound and modifying the club head based on the evaluation includes making a golf ball and club head impact under conditions related to actual play. For example, a golfer can be directed to strike a ball with a club using her normal golf swing, and the sound produced thereby recorded and stored. Club/ball impact speed can be varied by selecting golfers with differing swing speeds, generally in a range of about 50 mph to about 130 mph. Higher swing speeds tend to produce more sound and thus can be more conveniently analyzed. A time-varying spectrum is then obtained that includes amplitudes (as a function of time) of the various frequency components of the recorded acoustic signal. A complex set of frequency components is generally produced, and thus one or more club head surfaces including rear cap component compositions can be selected to determine if one or more frequency components should be associated with particular rear cap component compositions. For example, club head surface displacements for a club head striking surface at one or more selected frequencies (based on the previously determined frequency components) are determined by measuring surface vibration or otherwise determined or estimated. At some frequencies, the selected surface (for example, the striking surface) can exhibit little displacement so that this frequency component should be associated with some other club head surface. In some cases, a low or lowest order vibration mode of the striking surface can be observed based on a striking surface displacement pattern. A lowest order mode of a club face is associated with relatively large displacements at the selected frequency at a striking face center and relatively small (or no) displacements at the striking face perimeter.

The loudness (sones), sound power (watts) and acoustic amplitude (dB) data described in the present application is obtained through a specific test procedure. The loudness and amplitude are measured using a microphone positioned at exactly 64 inches directly above the ball at impact as measured from the outer surface of the ball to the outer surface of the microphone's sound recording portion. The microphone used in the test procedure is a G.R.A.S. Sound and Vibration pre-polarized microphone type 40AE. The microphone was connected to a Brüel & Kjaer Pulse™ noise and vibration analysis system (model 3160-B-140). The furthest distance of any impact location away from the center-face of the club was 11 mm as measured from the center face to the center point of the impact location. Post-processing of the recorded data was done using the Pulse™ Sound Quality software from Brüel & Kjaer.

In one embodiment, the club head has 1) a peak A-weighted sound pressure level of the club head of less than 5 Pa upon striking a golf ball at about 110 mph, measured by a microphone positioned at 64 inches above the golf ball, 2) a peak unweighted acoustic amplitude of less than 113 dB upon striking a golf ball at about 110 mph, measured by a microphone positioned at 64 inches above the golf ball 3) a loudness of less than 240 sones upon striking a golf ball at about 110 mph, measured by a microphone positioned at 64 inches above the golf ball.

In addition to structural modification of the club head such as the use of internal rib placement to control the acoustic properties of the club head, in one embodiment a sound altering material may be added to the polymeric material used to prepare the rear cap component in order to control the nature of the acoustic properties of the club head. The sound-altering material is configured to alter the sound produced when the club head strikes a golf ball, without substantially altering other properties of the club head. The sound-altering material can be either a sound-enhancing material configured to increase the sound output produced when the golf ball is struck, or a sound-dampening material configured to decrease the sound output produced when the golf ball is struck. Preferred sound-enhancing materials include metal stearates, such as zinc stearate or calcium stearate, or solid glass beads, optionally having a surface treatment. Preferred sound-dampening materials include but are not limited to metal salts such as metal carbonates and sulfates, such as barium sulfate and barium carbonate.

In certain embodiments of the present invention the golf club head may be attached to the shaft via a removable head-shaft connection assembly as described in more detail in U.S. Pat. No. 8,303,431 issuing on Nov. 6, 2012 to Taylor Made Golf Co. Inc., the entire contents of which are incorporated by reference herein. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. No. 8,025,587 issuing on Sep. 27, 2011, U.S. Pat. No. 8,235,831 issuing on Aug. 7, 2012, U.S. Pat. No. 8,337,319 issuing on Dec. 25, 2012, as well as copending US Publication No. 2011/0312437A1 filed on Jun. 22, 2011, US Publication No. 2012/0258818 A1 filed on Jun. 20, 2012, US Publication No. 2012/0122601A1 filed on Dec. 29, 2011, US Publication No. 2012/0071264 A1 filed on Mar. 22, 2011 as well as copending U.S. application Ser. No. 13/686,677 filed on Nov. 27, 2012, the entire contents of which patent, publications and applications are incorporated in their entirety by reference herein.

In certain embodiments of the present invention the golf club head may feature an adjustable mechanism provided on the sole portion to "decouple" the relationship between face angle and hosel/shaft loft, i.e., to allow for separate adjustment of square loft and face angle of a golf club. For example, some embodiments of the golf club head may include an adjustable sole portion that can be adjusted relative to the club head body to raise and lower the rear end of the club head relative to the ground. Further detail concerning the adjustable sole portion is provided in U.S. Pat. No. 8,337,319 issuing on Dec. 25, 2012, U. S. Patent Publication Nos. US2011/0152000 A1 filed on Dec. 23, 2009, US2011/0312437 filed on Jun. 22, 2011, US2012/0122601A1 filed on Dec. 29, 2011 and copending U.S. application Ser. No. 13/686,677 filed on Nov. 27, 2012, the entire contents of each of which are incorporated herein by reference.

According to some embodiments of the golf club heads described herein, the golf club head may also include a slidably repositionable weight positioned in the sole and/or skirt portion of the club head. Among other advantages, a slidably repositionable weight facilitates the ability of the end user of the golf club to adjust the location of the CG of the club head over a range of locations relating to the position of the repositionable weight. Further detail concerning the slidably repositionable weight feature is provided in more detail in U.S. Pat. Nos. 7,775,905 and 8,444,505 and U.S. patent application Ser. No. 13/898,313 filed on May 20, 2013 and U.S. patent application Ser. No. 14/047,880 filed on Oct. 7, 2013 both in the name of Taylor Made Golf Co. Inc., the entire contents of each of which are hereby incorporated by reference herein as well the contents of paragraphs [430] to [470] and FIGS. 93-101 of US Patent Publication No. 2014/0080622 (corresponding to U.S. patent application Ser. No. 13/956,046 filed on Jul. 31, 2013 in the name of Taylor Made Golf Co. Inc., the contents of which are hereby incorporated by reference herein.

According to some embodiments of the golf club heads described herein, the golf club head may also include a coefficient of restitution feature which defines a gap in the body of the club, preferably located on the sole portion and proximate the face. This coefficient of restitution feature is described more fully in U.S. patent application Ser. No. 12/791,025 to Albertsen et al., filed Jun. 1, 2010, and Ser. No. 13/338,197 to Beach, et al., filed Dec. 27, 2011 and Ser. No. 13/839,727 to Beach, et al., filed Mar. 15, 2013, the entire contents of each of which are incorporated by reference herein in their entirety.

Figure 11A:
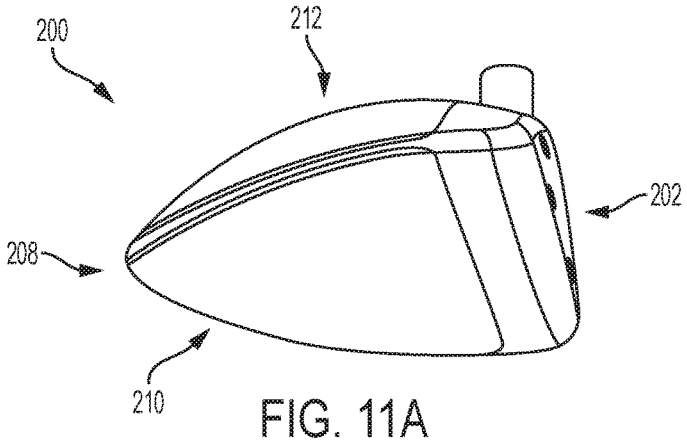
FIGS. 11A, 11B, 11C are side, bottom and front views of the embodiments of FIG. 11.
Figure 11B:
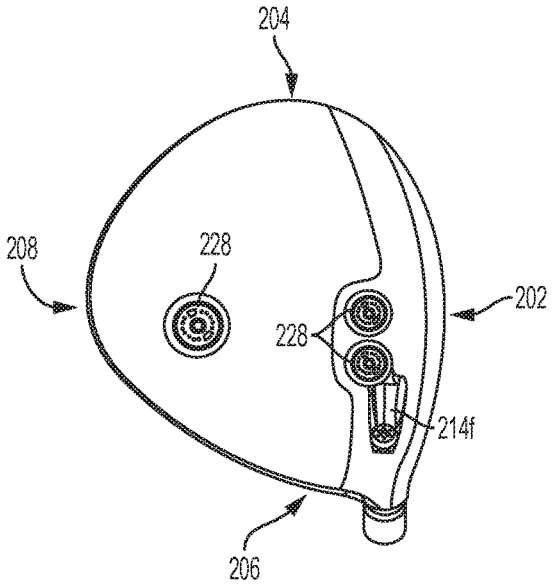
Figure 11C:
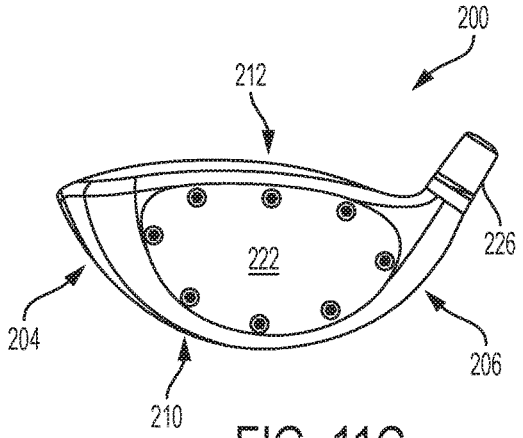
Figure 11D:
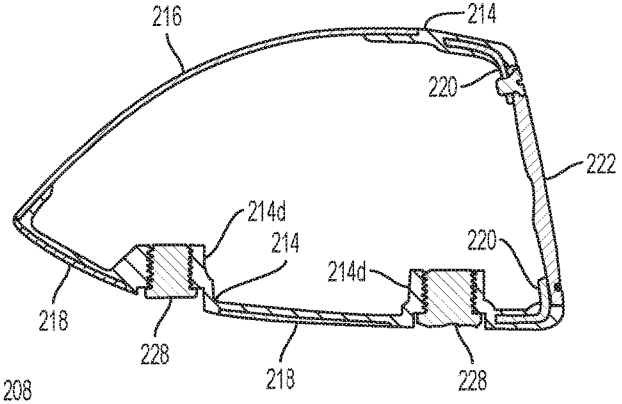
FIG. 11D is a vertical cross section taken along line 11D-11D of FIG. 11.
Figure 11E:
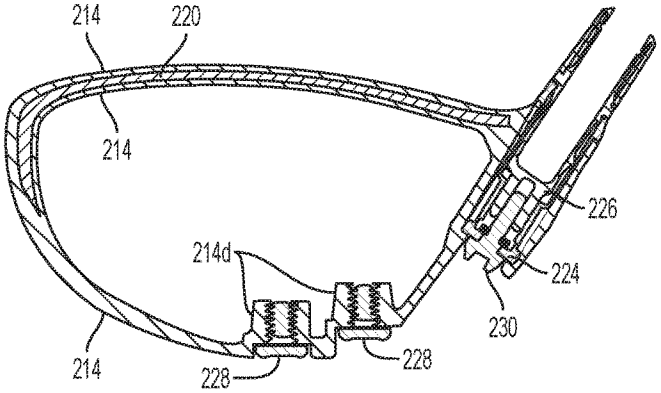
FIG. 11E is a vertical cross section taken along line 11E-11E of FIG. 11.
Figure 11:
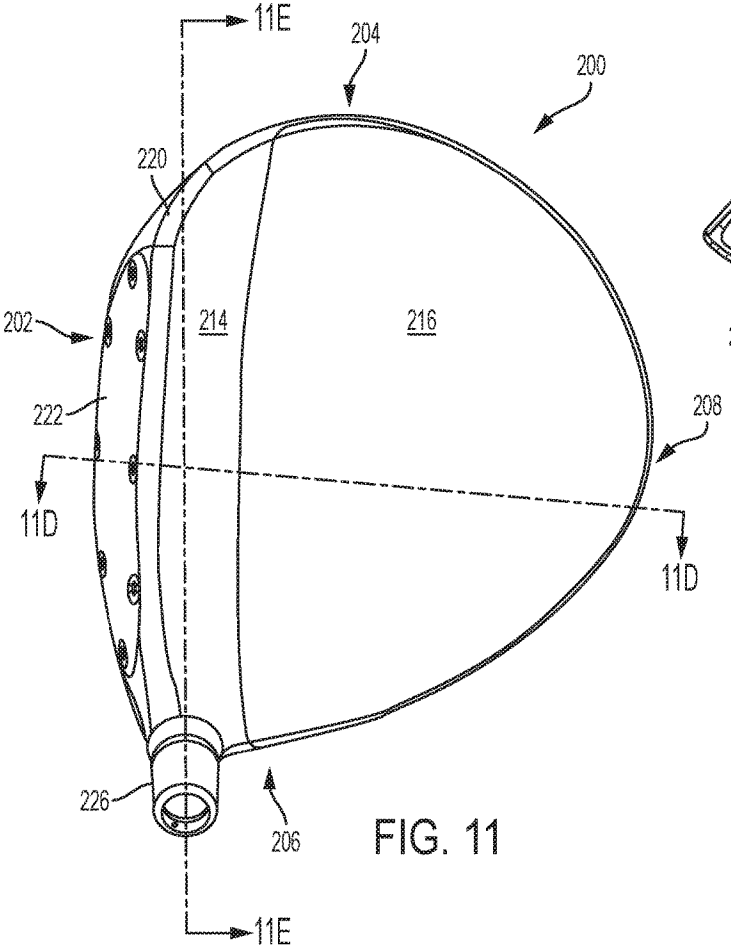
FIG. 11 is a top view of a metal wood club head in accordance with another embodiment.
Figure 12:
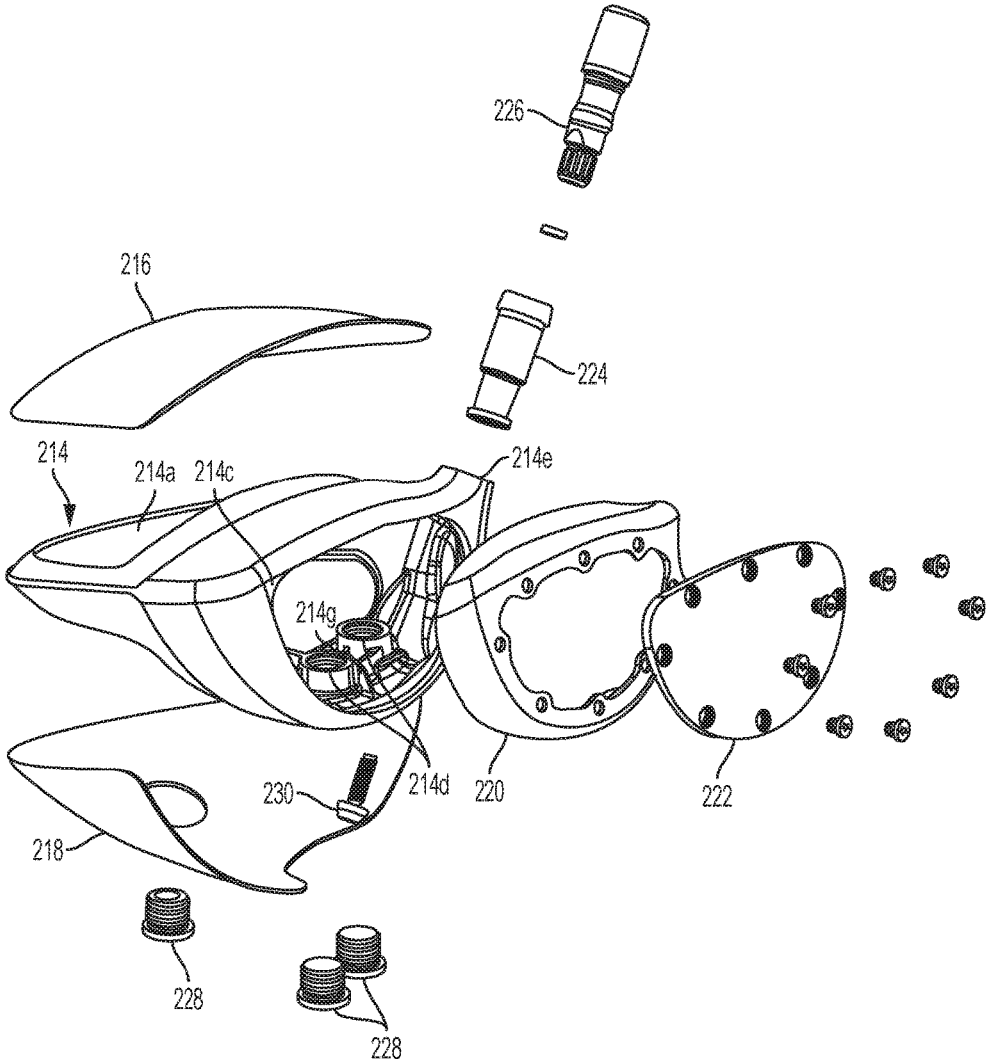
FIG. 12 is an exploded perspective view of the embodiment of FIG. 11.

An additional embodiment of a driver-type club head 200 is disclosed in FIGS. 11-13. As shown in FIG. 11, the club head 200 has a forward face area 202, toe area 204, heel area 206 opposite the toe area, and rear area 208 opposite the forward face area. FIGS. 11A, 11B and 11C illustrate other views of the club head 200, including a sole area 210 and crown area 212 opposite the sole area.

FIG. 12 is an exploded view of various components of the club head 200. The club head includes a main body or shell 214, crown insert 216, sole insert 218, face plate frame 220, face plate 222, FCT (flight control technology) support insert 224 (or adjustable lie/loft assembly as described earlier) and FCT component 226. In a preferred embodiment, one or more weights 228 may be attached, such as by threaded engagement, to one or more sole areas of the club head. The face plate 222 may be attached to the face plate frame 220 by a plurality of screws received within threaded openings of the frame 220 or by other securing means. The FCT support insert 224 and FCT component 226, which is inserted (roughly) coaxially within the insert 224, may be secured within the main body 214 by a screw 230 or other securing means.

The main body 214 is shown in greater detail in the different views of FIGS. 13A, 13B, 13C and 13D. The main body is a hollow structure that serves as a frame or skeleton for the club head, and may include a crown opening 214*a*, sole opening 214*b* and face opening 214*c*. The main body preferably includes one or more threaded openings 214*d* for receiving weights 228, a hosel opening 214*e* to receive the FCT insert 224 and FCT component 226, and a FCT screw port 214*f* to provide the FCT adjustment screw 230 with access to the threaded opening in the FCT component 226. The main body also may include one or more ribs 214*g* on internal surfaces of the body to provide structural reinforcement and/or adjust the acoustic properties of the head (as described previously). As explained further below, the main body preferably is not formed separately but is formed over the crown insert, sole insert and face plate frame.

The crown insert 216 and sole insert 218 can be made from a variety of composite and polymeric materials described above, and preferably from a thermoplastic material, more preferably from a thermoplastic composite laminate material, and most preferably from a thermoplastic carbon composite laminate material. For example, the composite material may be an injection moldable composite material, thermoformable material, thermoset composite material, or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

As described earlier, TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42 to 57%) will suffice. The material weighs 200 $g/m^2$.

Another similar exemplary material which may be used for the crown and sole inserts is TEPEX® DYNALITE 208. This material also has a carbon fiber volume range of 42 to 57%, including a 45% volume in one example, and a weight of 200 $g/m^2$. DYNALITE 208 differs from DYNALITE 207 in that it has a TPU (thermoplastic polyurethane) matrix or base rather than a polyphenylene sulfide (PPS) matrix, as described in more detail above.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming the sole and crown inserts.

Once the crown insert and sole insert are formed (separately) by the thermoforming process just described, each is cooled and removed from the matched die.

As shown in FIG. 12, the crown insert 216 and sole insert 218 each have a complex three-dimensional curvature corresponding generally to the crown and sole shapes of a driver-type club head and specifically to the design specifications and dimensions of the particular head designed by the manufacturer. It will be appreciated that other types of club heads, such as fairway wood-type clubs, may be manufactured using one or more of the principles and materials described herein.

The face plate frame or insert 220 serves to strengthen the club head in areas of high stress where the impact load resulting from a ball strike on the face plate 222 is transmitted to the rest of the club head, specifically, the transition region where club head transitions from the face to the crown, sole and skirt areas, as described above. The face plate frame 220 provides a structural ring and boundary around an opening that provides access to the hollow club head interior (before face plate 222 is attached).

The face plate frame preferably is made of a metal material, as described above, and most preferably from a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The face plate frame may be formed by a conventional metal stamping process. The face plate frame may be made of other metals as well as non-metal materials. See, for example, the above material descriptions and applications/patents incorporated by reference in connection with frame component 30 and frame insert 21.

The main body 214 may be made from a variety of materials as described above, but preferably is made from a thermoplastic composite material that may be injection molded. The material used for the main body 214 preferably is compatible with the crown/sole insert material and may include, for example, thermoplastic composite materials, more preferably thermoplastic carbon composite materials and most preferably thermoplastic carbon composite materials having a PPS matrix/polymer (for reasons explained below). However, unlike the sole and crown inserts, the main body material preferably includes short, chopped carbon fibers suitable for injection molding over the inserts by, for example, insert molding or overmolding. For example, the main body material may include 30% short carbon fibers (by volume) having a length of about 1/10 inch, which reinforce the PPS matrix/polymer.

One example of a commercial material that may be used for the main body is RTP 1385 UP, made by RTP Company. Other examples include nylon, RTP 285, RTP 4087 UP and RTP 1382 UP. In a preferred example, the crown insert, sole insert and main body are made from compatible materials capable of bonding well to one another, but the crown insert and sole insert are made from continuous fiber composite material well suited for thermoforming while the main body is made of short fiber composite material well suited for injection molding (including insert molding and overmolding).

The club head is formed by placing the thermoplastic composite crown insert 216, thermoplastic composite sole insert 218 and metal face plate frame 220 in a mold and injection molding the thermoplastic main body material over the crown insert, sole insert and face plate frame (as, for example, by insert molding or overmolding). The injection molding process creates a strong fusion-like bond between the main body and crown and sole inserts due to their material compatibility, which preferably includes a common polymer/matrix (PPS in one preferred example). This is not the case with the metal face plate frame 220 which is not a compatible material for bonding and instead is mechanically captured by the main body, as described further below.

Figure 13A:
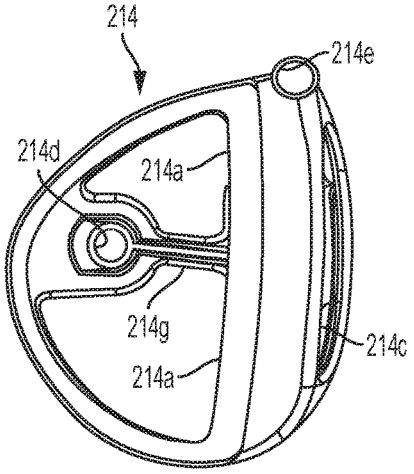
FIGS. 13A, 13B, 13C, 13D are top, side, bottom and front views of a frame component of the embodiment of FIG. 11.
Figure 13B:
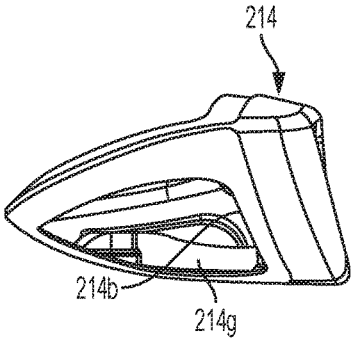
Figure 13C:
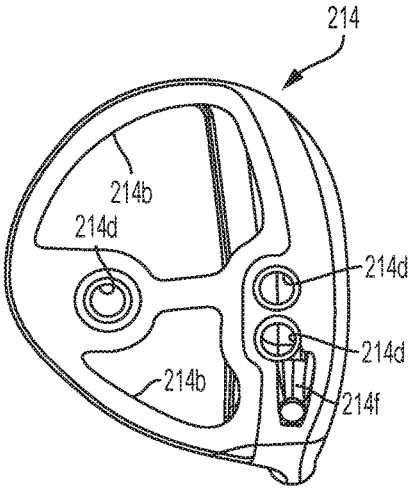
Figure 13D:
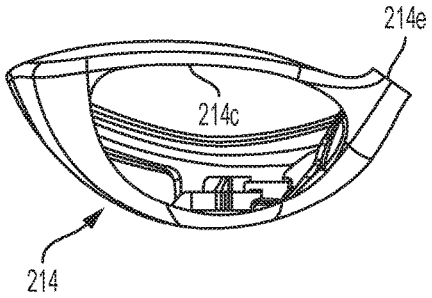

As illustrated in FIGS. 13A and 13B, the mold is shaped such that the crown and sole openings 214*a*, 214*b* of the main body 214 each have a lip or recess corresponding to the thickness of the crown and sole inserts, allowing the crown/sole inserts to be seamlessly joined to the main body. In other words, the exterior surface of the crown and sole are continuous and smooth at the interfaces between the main body and sole/crown inserts. Notably, the sole and crown inserts when formed preferably have a uniform thickness (allowing them to be easily formed using a thermoforming process). Alternatively, the inserts may have a variable thickness as, for example, if they are formed with additional layers or plies in select local areas of the insert(s).

FIGS. 11D and 11E further illustrate that after the injection molding (e.g., insert molding or overmolding) step the main body material is distributed on both sides and ends of the face plate frame 220, thereby mechanically capturing or retaining the peripheral edge of the face plate frame. Put another way, the forward or face end of the body gives the appearance of forming a ring-like slot that receives the top, bottom and side edges of the face plate frame (except that the main body in actuality is overmolded around the edge of the face plate frame).

Referring to FIG. 12, the main body 214 and face plate frame 220 mechanically joined thereto each have face side openings to allow mold parts located in the interior of the formed club head to be removed after the injection molding step.

Referring back to FIGS. 11D, 11E, the main body 214 overlies the face plate frame 220 on the face side but stops short of completely covering the face plate frame, leaving a portion of the face plate frame exposed to create a peripheral ledge or recess on all four sides to seat the face plate 222. The face plate 222 may be secured to the face plate frame by screws which pass through the face plate and are received within threaded openings in the face plate frame 220, as FIG. 11D illustrates. See also FIGS. 11C and 12. In another embodiment, the face plate may be glued, soldered, brazed or otherwise bonded to the face plate frame.

As shown best in FIG. 11D, the face side edge of the main body 214, which bounds the face opening, is formed during the injection molding process to have a thickness corresponding to the thickness of the peripheral edge of the face plate 222, thereby providing a smooth continuous surface where these two parts meet.

The face plate 222 may have a variable thickness, a coating applied thereto, or other features and characteristics described above in more detail.

One advantage of the injection molding process used to form the main body is that the main body may be formed with one or more weight ports 214*d*, internal ribs to provide reinforcement or acoustic adjustment, and/or other three-dimensional features. In the exemplary embodiment shown, two weight ports are formed in the sole near the face and one is formed in the sole near the aft portion of the head, each of which may receive a weight 228 (FIGS. 11D, 11E) to adjust the performance, acoustic and/or other characteristics of the head. Though not shown, the molding process may be used to form the main body with a slidable weight track for slidable weight(s) as described above.

As shown in FIGS. 11E and 12, the main body 214 is formed with a hosel 214*e* that may be used to receive a FCT (flight control technology) insert 224 and FCT component 226. As described more fully above, these components may be used to adjustably connect a shaft to the head to adjust the loft, lie and/or face angle of the club. The hosel of the main body is formed with opposed openings to seat the FCT insert 224 and receive the FCT component 226 (generally) coaxially within the insert 224. The lower opening or port 214*f* (FIG. 11B) aligns with the hosel and allows the screw 230 to threadably engage a lower end of the FCT component 226.

It will be appreciated that the thermoformed crown insert and sole insert preferably are materials that reinforce the injection molded main body, thereby providing strength, durability and stiffness to the head. In addition, the described designs and processes allow polymeric composite and titanium materials (or other metal materials) to be combined into a single head structure with resulting strength, durability and performance benefits. The face plate and face plate frame, which are located in the impact zone and subject to the greatest stress, can be made from titanium, titanium alloys or other high strength materials, and yet receive sufficient structural support in the context of a club head made largely of lightweight composite material. Traditionally, it has been difficult to integrate composite materials as a dominant material with titanium (or other metal) components in a high stress context caused by a high speed impact of the club head and golf ball. Also, the described main body construction, though made largely of a polymeric composite material, is suitable for use with removable weight and FCT features which tend to create additional stress on the main body.

Preferably, the polymeric compositions used to thermoform the crown and sole inserts have a matrix/polymer that is the same as or at least compatible chemically with the matrix/polymer used in the polymeric composition of the main body, such that the main body, crown insert and sole insert are strongly bonded or fused together when the main body is injection molded over the sole insert and crown insert. The bond between the components must be sufficient to withstand the typical impact loads and wear and tear on a golf club head with no worse than commercially acceptable frequency failure rates.

In an alternative embodiment, the crown insert 216 and sole insert 218 can be made using a thermoset process. In one example, the sole and crown inserts may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole (or crown) insert. Each insert is cooled and removed from its respective mold.

The carbon fiber reinforcement material for the thermoset sole/crown insert may be a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, Calif.

In one example, the prepreg sheets have a quasi-isotropic fiber reinforcement of 34-700 fiber having an areal weight of about 70 g/m$^2$ and impregnated with an epoxy resin (e.g., Newport 301) resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

The thermoset crown and sole inserts generally will not bond well to the main body if left untreated. Accordingly, the crown and sole inserts are each preferably coated with a heat activated adhesive as, for example, ACA 30-114 manufactured by Akron Coating & Adhesive, Inc. ACA 30-114 is a heat-activated water-borne adhesive having a saturated polyurethane with an epoxy resin derivative and adhesion promoter designed from non-polar adherents. It will be appreciated that other types of heat-activated adhesives also may be used. (Notably, though not necessary, the above described thermoplastic composite sole and crown inserts, made using a thermoforming process, also may be coated with a heat-activated adhesive prior to the injection molding step to promote an even stronger bond with the main body.)

After the coating step, the coated thermoset crown and sole inserts are then placed in a mold and the main body thermoplastic composite material is injection molded over the crown insert, sole insert and face plate frame as described above. During the injection molding step (e.g., insert molding or overmolded), heat activates the adhesive coating to promote bonding between the crown/sole inserts and the main body.

Notably, the foregoing description uses the terms injection molding over, overmolding and insert molding interchangeably since these processes, if not identical as a term of art, are sufficiently similar and understood to be suitable to join the main body to the insert(s).

In another alternative embodiment, the main body may be injection molded over only a crown insert, over only a sole insert, or over both (as described above with reference to FIGS. 11-13). In the case of a single sole insert, for example, the crown of the club head becomes an integral part of the main body and is formed with the rest of the main body when the main body is injection molded over the face plate frame and sole insert.

In another embodiment, the main body has a face opening and rearwardly directed rear opening, and includes an injection molded return portion. The return portion extends completely around the face, but excludes the face. The face has a bulge and roll radius or curvature, as conventionally understood, and terminates where the sole, crown and skirt edges of the face deviate from the bulge/roll radius as the face transitions to the crown, sole and skirt. In other words, the return portion of the main body starts where club head curvature deviates from the bulge/roll radius and extends rearwardly. In this embodiment, at least one composite insert is joined to the injection molded return portion of the main body.

The at least one composite insert may be a sole insert, crown insert, both sole and crown inserts, or a rear cap as described above in connection with FIGS. 1-10. The composite insert(s) may be made from a thermoplastic composite material, thermoplastic carbon composite material, other materials described above suitable for injection molding, thermoset composite materials such as continuous fiber thermoplastic composite materials, or composite materials suitable for thermoforming and the like. The return portion and composite insert(s) preferably are made of thermoplastic composite materials having compatible matrix material to facilitate injection molding the main body and return portion over the insert(s).

The return portion may extend rearwardly towards an aft portion of the club head a distance of about 1 to 10 mm, about 10 mm to 20 mm, about 20 mm to 30 mm, or greater than 30 mm. For example, this distance or return portion "depth" (as measured from the edge of the striking face where the edge curvature departs from the bulge and roll radius) also may be greater than about 40 mm or greater than about 50 mm. The composite insert can vary in size depending on how much of the club head's hollow shell is formed as the composite insert and joined to the main body. Accordingly, the one or more composite inserts (joined to the main body) may have an outer surface area greater than about 4000 mm$^2$, greater than about 6500 mm$^2$, or greater than about 9000 mm$^2$. The outer surface area of the one or more composite inserts may be greater than the outer surface area of the injection molded main body (including the return portion), such that the ratio of the outer surface area of the injection molded main body to the outer surface area of the composite insert(s) may be less than about 0.9, 0.8, 0.7, 0.6, 0.5, 0.4, 0.3, 0.2, or 0.1. The modulus of elasticity ratio of the injection molded main body to the modulus of the composite insert may be less than one. The injection molded body may have ribs that extend into the hollow enclosure formed by the composite insert when it is joined to the main body.

In another variation, the return portion may be made of more than one material, including at least (greater than) 20% thermoplastic material suitable for injection molding, as measured by the outer surface area of the return portion.

In one variation, the return portion may be joined to an aft portion (of the club head) having an undercut geometry by injection molding the main body over the aft portion. The aft portion may include at least one sole insert, at least one crown insert, at least one sole and one crown insert, or a rear cap that integrally combines a sole, crown and skirt at least in part into one component.

By way of definition, an undercut geometry is any indentation or protrusion in a shape that will prevent its withdrawal from a one-piece mold. Undercuts on molded parts are features that prevent the part from being directly ejected from an injection molding machine. They are categorized into internal and external undercuts, where external undercuts are on the exterior of the part and interior undercuts are on the inside of the part. Undercuts can still be molded, but require a side action or a side pull in the mold tooling. The severity of an undercut may be determined as a function of the feature's angle relative to the parting direction of the mold. Any feature with an angle less than 0 degrees constitutes an undercut and more negative angles constitute more severe undercuts. The undercut severity may also be determined as a function of the depth, when measured perpendicular to the parting direction of the mold, of the protrusion or indentation. Features with greater depth are more difficult to mold because they require greater translation of the side action in the mold tooling.

In another embodiment, the main body may be formed from a thermoplastic material suitable for injection molding as described above, joined to at least one composite insert (such as by injection molding over the composite insert) and have a mass that is at least about 20% of the mass of the entire club head (main body, composite insert, face plate, hosel, etc.), or at least about 30% of the mass of the entire club head. The composite insert(s) may be formed from various materials as described above including thermoplastic composite materials, thermoplastic carbon fiber composite materials and continuous fiber thermoplastic composite materials. The main body and at least one composite insert may be formed from thermoplastic composite materials having a compatible matrix to facilitate injection molding of the main body over the composite insert(s). Alternatively, as described above, the main body may be injection molded over a thermoset composite insert that has to be coated to facilitate overmolding. The composite insert may be a crown insert, sole insert, both crown and sole inserts, or rear cap that comprises most of the body forming the club head.

Thus, for example, the injection molded main body may have at one end a face portion proximate to the face of the club head and be joined at its other end to at least one composite insert at a joint to form an enclosed hollow club head. Using the club head's front to back dimension (FB dimension) as a reference, the joint or interface between the main body and at least one composite insert may be located within a distance of at least 50% of the FB dimension toward the face portion, at least 40% of the FB dimension toward the face portion, at least 30% of the FB dimension toward the face portion, or at least 20% of the FB dimension toward the face portion. Stated differently, the main body/insert joint or interface may be located proximal (i.e., closer) to the club head's face or more distal (farther) from the club head's face. In one example the joint may be a lap joint or one of the other types of joints discussed above with reference to FIGS. 1-10. The joint may be such that the injection molded main body overlies a portion of the composite insert or vice versa, as also described above.

The main body may have a thickness of about 0.75 mm to about 3 mm, as, for example, 3 mm. The composite insert(s) may have a thickness of about 0.5 to about 1.5 mm as, for example, about 0.8 mm. The main body and composite insert may be formed from materials as previously described, and may be made from compatible thermoplastic materials well-suited for overmolding. The insert may be a crown insert, sole insert, both a crown insert and sole insert or rear cap as described above.

In yet another example, a method of making a golf club head includes the steps of providing a forward portion having a return portion from a first thermoplastic material suitable for injection molding, providing at least one composite aft portion to define at least a portion of the head's sole and crown, and simultaneously forming the forward portion and joining the forward portion to the at least one composite aft portion by injection molding the thermoplastic material over the aft portion.

The aft portion may include one or more sole insert, one or more crown inserts, at least one sole insert and at least one crown insert, or a rear cap that includes an integrally formed crown sole and skirt. The thermoplastic injection moldable forward portion may be made of materials as described above in connection with the main body. The aft portion may be made of materials as described above in connection with the crown and sole inserts and, in one example, may be formed from a continuous fiber thermoplastic material suitable for thermoforming.

In yet another example, the injection molded material of the main body described earlier or the forward portion just described may be greater than 30% by volume, greater than 40% by volume or greater than 50% by volume of the entire club head's material volume.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment. It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club head having a face, sole, crown, heel and toe, the club head comprising:

a face component having surfaces defining the face, a sole return portion, a crown return portion, a toe return portion, and a heel return portion; and a rear shell joined to the face component at the sole return portion, crown return portion, toe return portion and heel return portion, the rear shell comprising at least in part a polymeric material;

wherein the rear shell is joined to the face component by one or more of a crown insert, sole insert or skirt insert, the one or more inserts being overmolded by the rear shell and creating a discontinuity between the face component and rear shell to form a channel.

2. The club head of claim 1 wherein the face component is made of a metal or metal alloy.

3. The club head of claim 2 wherein the polymeric material is selected from the group of thermoset polyurethanes, thermoset polyureas, thermoplastic polyurethanes, thermoplastic polyureas, polyamides (PA), polyketones (PK), polyphenylene sulfides (PPS), polyphthalamides (PPA), thermoplastic urethane (TPU) and any combination thereof.

4. The club head of claim 1 wherein the rear shell is selected from the group of thermoset polymers and thermoplastic polymers.

* * * * *